US009010602B2

(12) United States Patent
Budz et al.

(10) Patent No.: US 9,010,602 B2
(45) Date of Patent: Apr. 21, 2015

(54) TOWEL DISPENSER

(75) Inventors: Gregory D. Budz, Sobieski, WI (US); Michael R. Kilgore, Little Suamico, WI (US); Jonathan R. Aumann, DePere, WI (US); John R. Moody, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 1941 days.

(21) Appl. No.: 10/366,120

(22) Filed: Feb. 13, 2003

(65) Prior Publication Data

US 2003/0164079 A1 Sep. 4, 2003

Related U.S. Application Data

(60) Provisional application No. 60/357,245, filed on Feb. 15, 2002, provisional application No. 60/417,637, filed on Oct. 11, 2002.

(51) Int. Cl.
*A47K 10/36* (2006.01)

(52) U.S. Cl.
CPC ..... *A47K 10/36* (2013.01); *A47K 10/3687* (2013.01); *Y10S 83/949* (2013.01)

(58) Field of Classification Search
CPC ..... A47K 10/36; A47K 10/3687
USPC ..... 83/648–650, 949, 648–650; 225/16, 34, 225/77; 242/560, 560.1, 564.1, 564.2, 242/564.4, 596.8; 312/34.19, 34.22, 34.8
See application file for complete search history.

(56) References Cited

U.S. PATENT DOCUMENTS

| | | | | | |
|---|---|---|---|---|---|
| 3,038,598 | A | | 6/1962 | Layton et al. | 242/560.1 |
| 3,606,125 | A | | 9/1971 | Tucker et al. | 226/130 |
| 4,165,138 | A | * | 8/1979 | Hedge et al. | 242/560 |
| 4,260,117 | A | | 4/1981 | Perrin et al. | 242/564.2 |
| 4,358,169 | A | * | 11/1982 | Filipowicz et al. | 225/8 |
| 4,378,912 | A | | 4/1983 | Perrin et al. | 242/560.1 |
| 4,403,748 | A | | 9/1983 | Cornell | 242/560.1 |
| 4,635,771 | A | | 1/1987 | Shoji et al. | 192/41 A |
| 4,756,485 | A | * | 7/1988 | Bastian et al. | 242/560.1 |
| 4,807,824 | A | | 2/1989 | Gains et al. | 242/560.1 |
| 4,846,412 | A | * | 7/1989 | Morand | 242/560.1 |
| 5,655,722 | A | | 8/1997 | Muckridge | 242/295 |
| 5,924,617 | A | * | 7/1999 | LaCount et al. | 225/16 |
| D417,109 | S | | 11/1999 | Johnson et al. | D6/518 |

(Continued)

FOREIGN PATENT DOCUMENTS

| | | |
|---|---|---|
| CA | 918610 | 1/1973 |
| CA | 918611 | 1/1973 |
| EP | 0 319 166 A1 | 6/1989 |

*Primary Examiner* — Clark F Dexter
(74) *Attorney, Agent, or Firm* — Sutherland Asbill & Brennan LLP

(57) ABSTRACT

An improved towel dispenser includes a rotatable driveshaft mounted in a one-way clutch bearing fitted with a pinion which engages a vertically oriented press bar assembly including at its lower portion a rack which engages the pinion to advance paper towel through a dispensing nip upon pivotable motion of the press bar assembly. A dispensing chute located below the dispensing nip includes a lower shelf configured to direct web forwardly toward the front portion of a dispenser. The gear rack is preferably an internal gear rack integrally formed with a unitary press bar assembly member. The dispensing chute is configured such that an angle between a cutting-blade and the outer lip of the shelf makes an angle with a vertical of at least about 25°.

31 Claims, 24 Drawing Sheets

(56) References Cited

U.S. PATENT DOCUMENTS

| | | | | | |
|---|---|---|---|---|---|
| 5,979,822 | A | | 11/1999 | Morand et al. | 242/564.2 |
| 6,032,898 | A | * | 3/2000 | LaCount et al. | 242/564.2 |
| 6,105,898 | A | * | 8/2000 | Byrd et al. | 242/564.1 |
| 6,237,871 | B1 | * | 5/2001 | Morand et al. | 242/564.2 |
| 6,250,530 | B1 | * | 6/2001 | LaCount et al. | 225/10 |
| 6,336,542 | B1 | | 1/2002 | Mintonye, II | 193/37 |
| 6,826,991 | B1 | * | 12/2004 | Rasmussen | 83/334 |

* cited by examiner

TOWEL DISPENSER

CLAIM FOR PRIORITY

This non-provisional application is based upon Provisional Patent Application Ser. No. 60/357,245 of the same title, filed Feb. 15, 2002, as well as Provisional Patent Application Ser. No. 60/417,637, filed Oct. 11, 2002, entitled "Dispenser for Dispensing Continuous Sheet Material". The priorities of the foregoing applications are hereby claimed.

TECHNICAL FIELD

The present invention relates generally to paper towel dispensers and in one preferred embodiment to a dual roll towel dispenser and in another preferred embodiment to a towel dispenser of the type having a primary feed roll and a reserve roll wherein the transfer between the rolls involves use of a cradle transfer mechanism.

BACKGROUND ART

Paper towel dispensers of the class used for commercial establishments frequently include a cutting blade for severing a length of towel from a roll. Such dispensers are well known. One particularly decorative design which may be employed in connection with the present invention is shown in U.S. Pat. No. DES 417,109 to Johnson et al. The design of the '109 patent includes a generally cylindrically shaped upper portion and a lower, forward facing delivery area for dispensing towel. It is known in the art to provide towel dispensers with a dispensing mechanism including a drive roll coupled to a reciprocating operating lever. In this respect there is shown in U.S. Pat. No. 3,606,125 to Tucker et al. a towel dispenser provided with a reciprocating lever. The lever is coupled to a pair of gear racks internal to the dispenser. These gear racks each engage a respective drive gear, one of which is idle during operation, depending on the stroke direction. This action is achieved through a plurality of engagement mechanisms as can be seen in the '125 patent. See also Canadian Patent No. 918,610 and 918,611 also to Tucker et al.

Towel dispensers of the type used in a commercial establishments frequently include those adapted to dispense towels from a primary roll and a reserve roll. These dispensers typically include a rotatable dispensing drive roller and a means for feeding the sheet material from the reserve roll when the primary roll is depleted. In this respect, there is shown in U.S. Pat. No. 4,378,912 to Perrin et al. a dispenser including a rotatable dispensing roller with a groove, sensing means for entering the groove when sheet material from the primary roll is depleted and tucker means responsive to movement of the sensing means to engage the reserve roll of sheet material and introduce it into a nip between rotatable rollers. That is to say, when the primary roll becomes depleted the tucker means will urge material from the reserve roll into the nip between the nip and drive roll to start dispensing from the reserve roll of paper towel. Such towel dispensers may or may not include a push-bar. See, U.S. Pat. No. 5,979,822 to Morand et al. The disclosure of the foregoing patents are incorporated herein by reference.

The present invention provides an improved push-bar, drive mechanism and dispensing chute combination which is readily employed in connection with dispensers of the class generally described above.

SUMMARY OF INVENTION

There is provided generally in accordance with the present invention a towel dispenser including a housing defining an enclosure with an enclosure front portion, enclosure sidewall portions, and enclosure upper and lower portions. The improved towel dispenser includes a dispensing nip in the lower portion of the housing defined in part by a drive roll with a first friction surface, which may be segmented including a plurality of disks, and a nip defining member, such as a nip roll or a wall, defining a second friction surface which likewise may be segmented. Means are provided for rotatably mounting a roll of paper towel above the dispensing nip and feeding a continuous web of paper towel downwardly where the web is gripped between the first and second friction surfaces of the dispensing nip. The drive roll is mounted for rotation about an axis and driven by a rotatable driveshaft mounted in a one-way clutch bearing coupled to the drive roll and adapted to impart rotation thereto. The one-way clutch bearing has a drive pinion secured about its periphery. A vertically oriented press bar assembly having an upper assembly portion is mounted pivotably about its upper portion for inward and outward motion with respect to the enclosure defined by the housing of the dispenser. The press bar includes at its lower portion a rack which engages the pinion coupled to the drive roll wherein the drive roll is adapted to advance the paper towel through the nip upon pivotable motion of the press bar. Means for biasing the press bar towards the front portion of the dispenser such that the press bar projects forwardly from the housing in a rest position are typically provided in the form of a spring. A dispensing chute located below the dispensing nip has a lower shelf configured to direct the web forwardly towards the front portion of the dispenser. Preferably the chute has an arcuate profile and is provided with a plurality of ridges. A cutting blade disposed below the dispensing nip and above the lower shelf of the dispensing chute is configured to the facilitate dispensing of the towel from the roll.

Typically the rack is an internal rack, that is to say, a rack with a radius of curvature whose origin is in the same direction as the gear teeth project from the rack and is configured to engage the pinion along a lower circumferential position with respect to the axis of rotation of the pinion which, in turn, drives the drive roll of the dispensing nip. The one-way clutch bearing is advantageously, a one-way clutch needle bearing as is known in the art. Such bearings are available from INA (Germany), a suitable bearing being INA Model No. HFZ 040 708E. The lower shelf of the dispensing chute extends forwardly with respect to the cutting blade over a distance such that a line between an outer lip of the lower shelf and the cutting blade makes an angle of at least about 25° with respect to a vertical. Preferably, that angle is at least about 30° with respect to a vertical.

In a particularly preferred embodiment the press bar assembly includes a unitary support member with a molded-in rack including means for receiving a press bar handle.

The inventive towel dispenser of the present invention may be of any suitable type, for example, the present invention is used in connection with towel dispensers described above or of the general class including a cradle transfer mechanism disclosed in U.S. Pat. No. 4,807,824 to Gains et al., the disclosure of which is incorporated by reference. This type of towel dispenser includes means for dispensing a primary roll and a reserve roll of paper towel. The primary roll is supported on a cradle while the rolls being dispensed are preferably of the type shown in U.S. Pat. No. 3,038,598 being wound about a core and having a bearing receptacle formed in one of the roll to define a bearing wall of layers of paper toweling. A bearing member mounted on the sidewall of the cabinet projects inwardly to the bearing receptacle to support the reserve roll. The other end of the reserve roll is supported by another bearing mechanism. When enough toweling has been removed from the bearing receptacle to make it disappear, the partially depleted roll will fall down into the cradle to become the primary roll. In due course an attendant would open the cabinet and install a new reserve roll. These types of dispensers also include indicators to notify the attendant that the primary roll has fallen into the cradle so that it may be replaced. However, the rolls may be of any type and need not have the above described drop down feature, in which case the attendant would manually remove the partially depleted roll and place it on the cradle before installing a new roll.

So also, dispensers of the present invention may be of the general class shown in U.S. Pat. No. 4,260,117 to Perrin et al., the disclosure of which is incorporated herein by reference. In this type of dispenser two drive rolls are mounted generally co-axially aligned on a drive rod and rotatable relative thereto with a clutch mechanism on the rod between the drive rolls being axially shiftable to transmit rotation from the rod to either of the drive rolls while the other roll remains stationary. Any suitable means may be used for activating the drive transfer mechanism. For example, split-core paper towels may be used in connection with sensor arms as is known in the art.

One preferred embodiment is a dispenser for dispensing a continuous web of sheet material from a roll, the dispenser including: supports for supporting a pair of rolls of sheet material; feed rollers for dispensing a length of sheet material from the rolls to the user, wherein a first feed roller dispenses sheet material from a first of the rolls and a second feed roller dispenses sheet material from a second of the rolls; a spool selectively engaging the feed rollers to drive only one feed roller at a time; a drive shaft for rotating the spool; a drive gear coupled to the drive shaft via a one-way bearing to rotate the drive shaft when the drive gear is rotated in one direction and to permit free rotation of the drive gear relative to the drive shaft when the drive gear is rotated in an opposite direction; sensing arms adapted to detect the exhaustion of the rolls, wherein a first sensing arm moves the spool to engage the second feed roller when detecting the exhaustion of the first roll, and a second sensing arm moves the spool to engage the first feed roller when detecting the exhaustion of the second roll; and a generally vertical push arm pivotally mounted for swinging about a pivot axis extending through an upper end of the push arm, the push arm being pushed generally into the dispenser to dispense a length of sheet material, the push arm further including a spring to normally bias the push arm to a rest position and a rack to rotate the drive gear in opposite directions as the push arm swings about the pivot axis. Preferably the push arm includes at least one slot spaced apart from the pivot axis through which is received a guide fixed relative to the push arm to provide support for the movement of the push arm and the push arm is received with a casing secured to the dispenser, the casing comprising a pair of opposite side members that form an opening in which the push arm swings, at least one side member including at least one connecting member that spans the opening to secure the side members together, the connecting member defining the guide that extends through the slot.

In another preferred embodiment, there is provided a dispenser for dispensing a continuous web of sheet material from a roll, the dispenser comprising: a housing forming an enclosure with a discharge chute through which a length of the sheet material is dispensed to a user; at least one roll supported within the housing for rotation during a dispensing operation; a feed mechanism including a feed roller for dispensing a length of the sheet material from the roll; an actuator unit for operating the feed mechanism, the actuator unit including a casing, a push arm, a drive mechanism and a spring secured together as a separable unit from the housing; the drive mechanism including a drive gear supported with the casing and a drive stem projecting out of the casing for interconnection with the feed mechanism, the drive gear being coupled to the drive stem to rotate the drive stem only when the drive gear is rotated in a first direction; the push arm having a generally vertical orientation and being pivotally mounted to the casing for swinging about a pivot axis extending through an upper end of the push arm, the push arm being pushed generally into the housing to dispense a length of sheet material, the push arm including a rack in engagement with the drive gear to rotate the drive gear when the push arm swings about the pivot axis; and the spring engaging the push arm and the casing to normally bias the push arm to a rest position. Here again, preferably the push arm includes at least one slot spaced apart from the pivot axis through which is received a guide fixed relative to the push arm to provide support for the movement of the push arm and the push arm is received within a casing secured to the dispenser, the casing comprising a pair of opposite side members that form an opening in which the push arm swings, at least one side member including at least one connecting member that spans the opening to secure the side members together, the connecting member defining the guide that extends through the slot.

In yet another preferred embodiment, there is provided a dispenser for dispensing a continuous web of sheet material from a roll, the dispenser comprising: a housing; supports for supporting at least one roll of sheet material within the housing; a feed roller for dispensing a length of sheet material from the roll to the user; a drive gear to rotate the feed roller; and a generally vertical push arm pivotally mounted for swinging about a pivot axis extending through an upper end of the push arm, the push arm being pushed generally into the housing to dispense a length of sheet material, the push arm including a spring to normally bias the push arm to a rest position, a rack to rotate the drive gear as the push arm swings about the pivot axis, and at least one slot spaced apart from the pivot axis through which is received a guide fixed relative to the push arm to provide support for the movement of the push arm. Preferably the push arm is received within a casing secured to the dispenser, the casing comprising a pair of opposite side members that form an opening in which the push arm swings, at least one of the side members including at least one connecting member that spans the opening to secure the side members together, the connecting member defining the guide that extends through the slot. Typically at least one of the side members includes at least one additional connecting member that spans the opening to define a pivot pin for the push arm. The push arm may include a front face to be contacted by a user to operate the dispenser, the front face having a generally concave shape wherein a bottom portion of the front face extends outward from the housing farther than an upper portion of the front face.

In still yet anther embodiment, there is provided a dispenser for dispensing a continuous web of sheet material from a roll, the dispenser comprising; a housing; supports for supporting at least one roll of sheet material within the housing; a feed roller for dispensing a length of sheet material from the roll to the user; a drive gear to rotate the feed roller; and a generally vertical push arm pivotally mounted for swinging about a pivot axis extending through an upper end of the push arm, the push arm being pushed generally into the housing to dispense a length of sheet material, the push arm including a spring to normally bias the push arm to a rest position, a rack to rotate the drive gear as the push arm swings about the pivot axis, and a front face to be contacted by a user to operate the dispenser, the front face having a generally concave shape wherein a bottom portion of the front face extends outward from the housing farther than an upper portion of the front face.

These and other features of the present invention will be better appreciated by reference to the appended drawings and the description which follows.

BRIEF DESCRIPTION OF DRAWINGS

The invention is described in detail below with reference to the various figures wherein.

DETAILED DESCRIPTION

Figure 1:
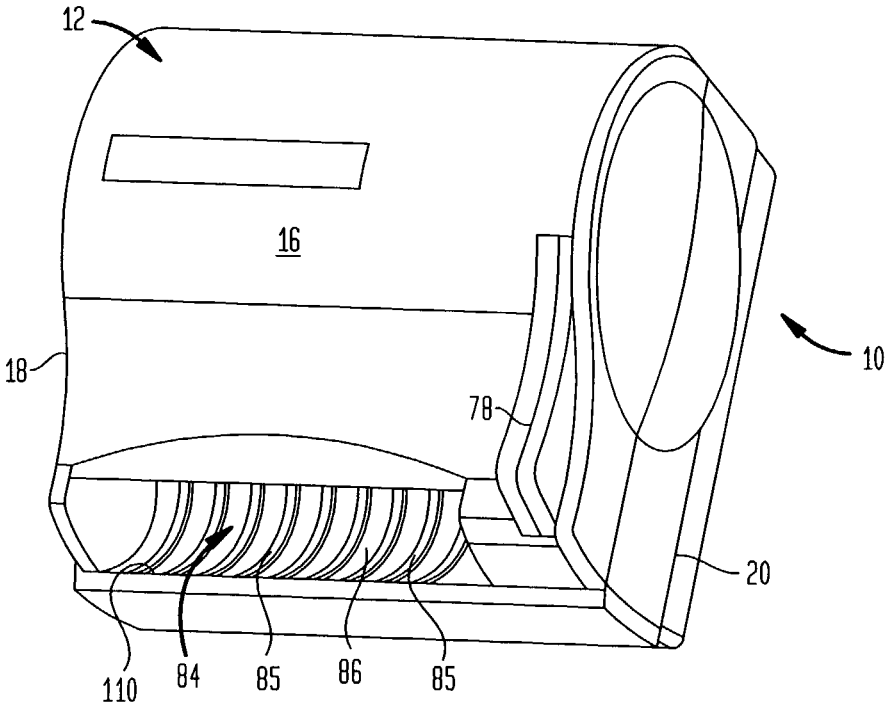
FIG. 1 is a perspective view of a first embodiment of a towel dispenser constructed in accordance with the present invention.
Figure 2:
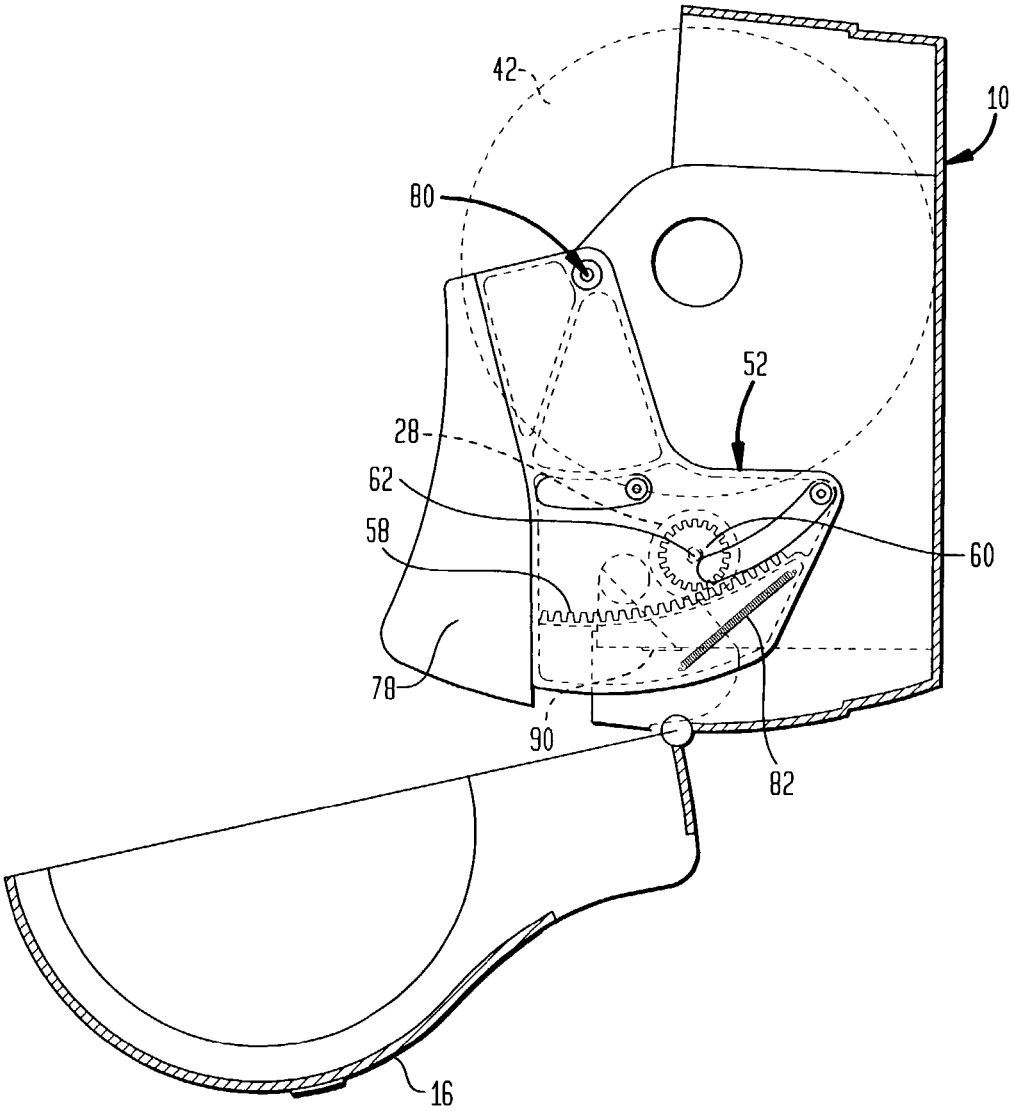
FIG. 2 is a schematic diagram showing various parts of the inventive dispensers.
Figure 2A:
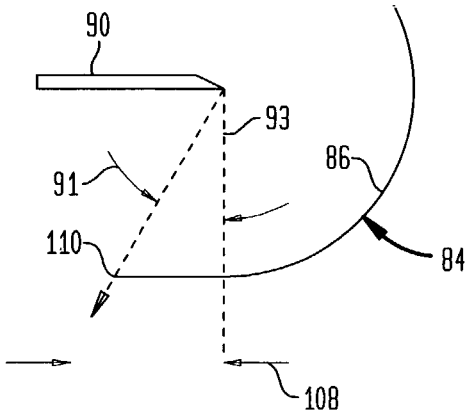
FIG. 2(A) is a schematic diagram illustrating the angle between the lower lip of the dispenser chute and the cutting blade.
Figure 3:
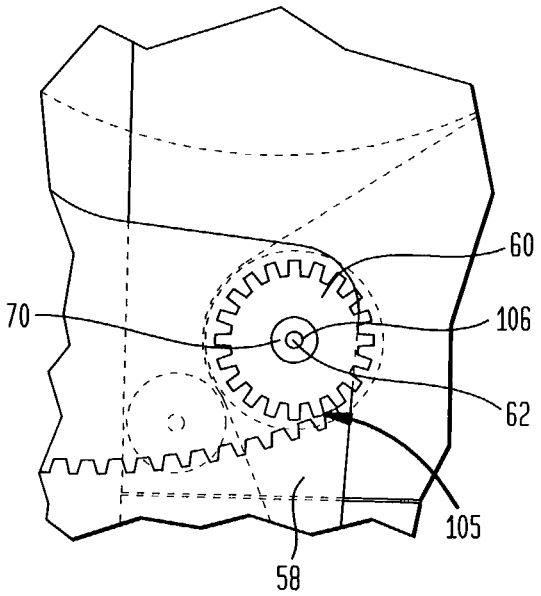
FIG. 3 is a schematic detail showing interaction of the clutch bearing and push bar assembly of the present invention.
Figure 4:
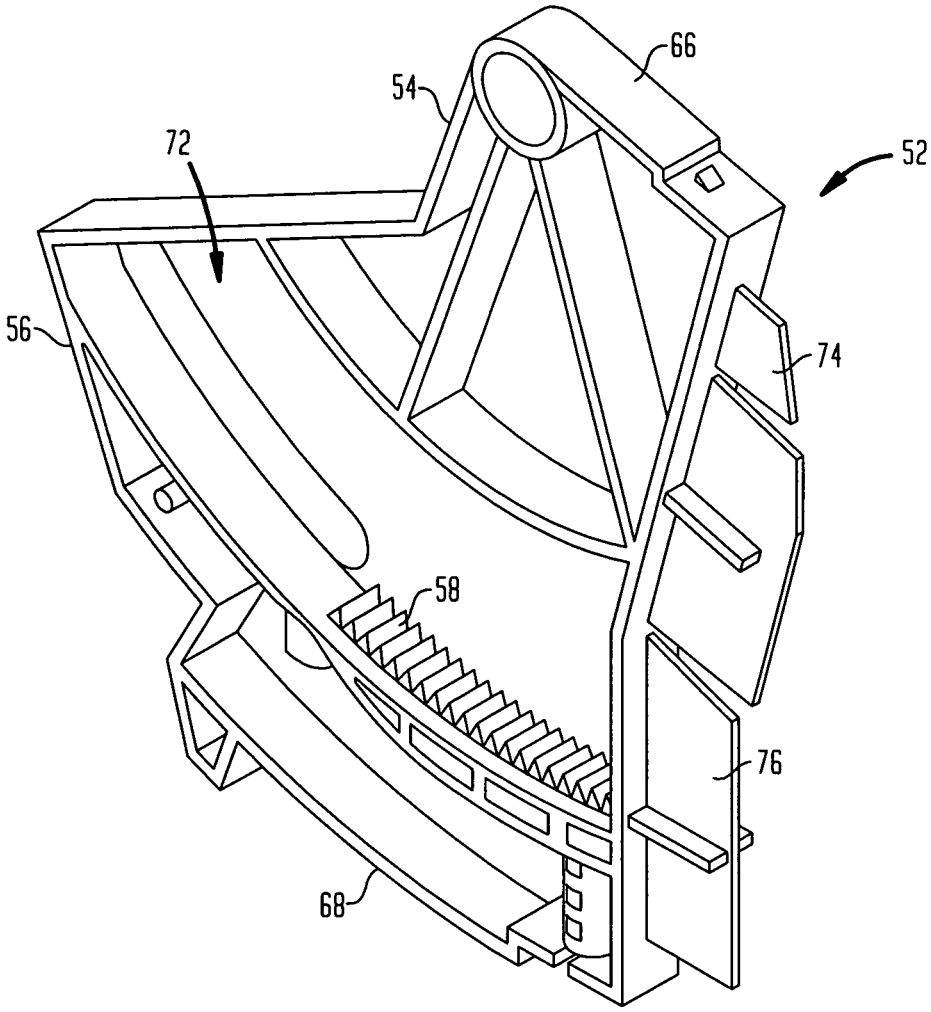
FIG. 4 is a schematic detail showing the unitary support member including a molded-in rack of the press bar assembly.
Figure 5:
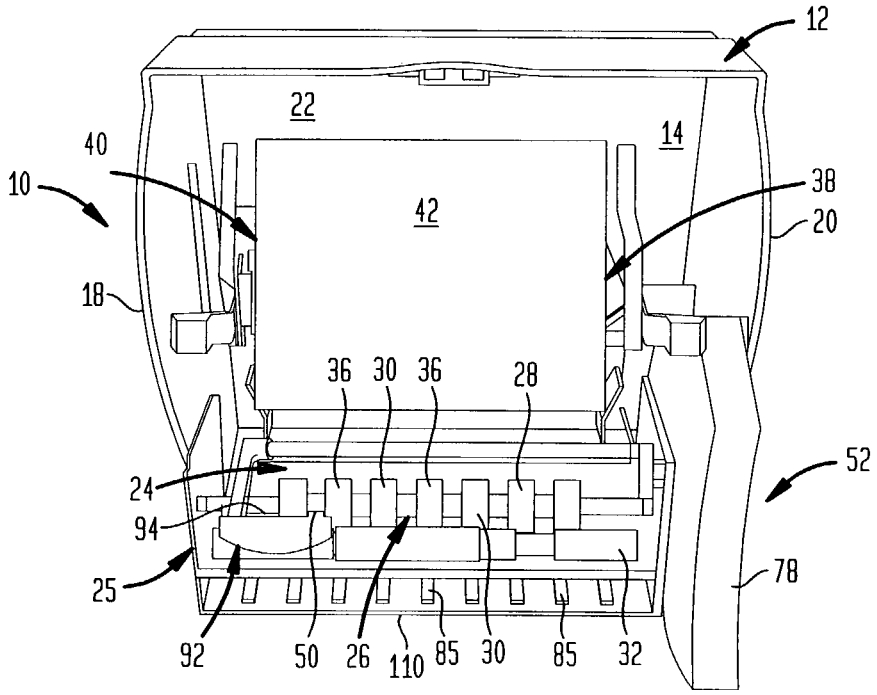
FIG. 5 is a schematic front interior view in elevation of the dispenser of FIG. 1.

The present invention is described in detail below in connection with several embodiments for purposes of illustration only. Modifications to such embodiments, within the spirit and scope of the appended claims, will be readily apparent to those of skill in the art.

Referring generally to FIGS. 1 through 7, there is shown a first embodiment of a towel dispenser 10 constructed in accordance with the present invention. The towel dispenser of FIGS. 1 through 7 is a towel dispenser of the class for sequentially dispensing a primary roll of paper towel and a reserve roll of paper towel. Most preferably, the paper towel defines a bearing receptacle to releasably hold it in the upper position shown in FIG. 2 as noted above. Dispenser 10 includes a housing 12 defining an enclosure 14 with an enclosure front portion 16 and enclosure sidewall portions 18, 20 and an enclosure upper portion 22 and an enclosure lower portion 24. The dispenser optionally includes an inner, modular chassis indicated at 25 to mount the various parts as is known in the art and may be made of any suitable material, typically plastic.

A dispensing nip 26 in the lower portion of the housing is defined in part by a drive roll 28 with first friction surface 30 defined by drive disks 36 about the shaft of drive roll 28 and an second nip-defining roll 32 having a second friction surface 34 whereby dispensing nip 26 is defined there between.

At upper portion 22 of housing 12 there are provided hubs indicated at 38 and 40 for rotatably mounting a roll of paper towel in the upper portion of enclosure 14 above dispensing nip 26.

A roll 42, a continuous web of paper towel, is fed downwardly where the web is gripped between drive roll 28 and nip roll 32 by virtue of their friction surfaces. The friction surfaces may be continuous or may be formed with a plurality of disk-shaped members such as members 36. These may be made of any suitable material which provides friction which has a high coefficient of friction, such as a soft rubber roll or a tracked plastic roll and so forth as is known in the art.

Figure 6:
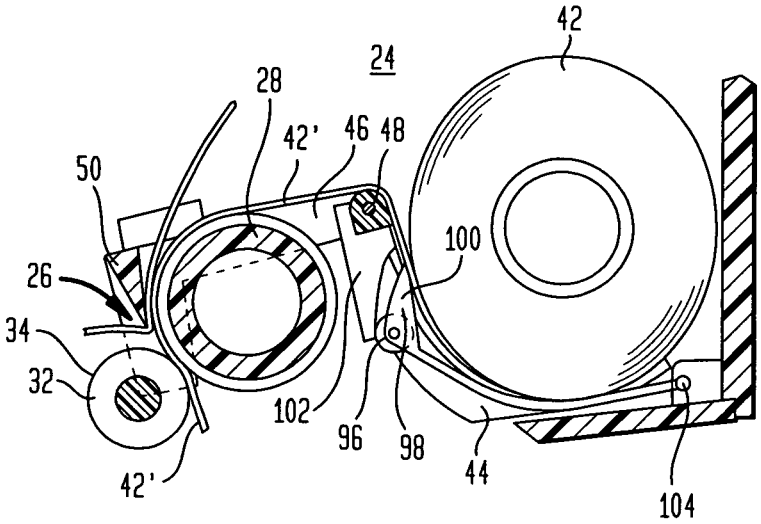
FIG. 6 and FIG. 7 illustrate operation of the cradle roll transfer mechanism which is utilized in connection with the dispenser of FIG. 1.

A cradle 44 for supporting roll 42 of paper towel in the lower portion of said enclosure is located behind dispensing nip 26 and configured so that the web may be fed forwardly to the dispensing nip after the roll has dropped to the cradle as can be seen in FIG. 6.

A lever member 46 coupled to cradle 44 is mounted for rotation about a fulcrum 48 wherein cradle 44 is disposed rearwardly with respect to the fulcrum 48 and lever member 46 extends forwardly of the fulcrum 48 and a lower portion of the dispenser and includes a tucker element 50.

Figure 7:
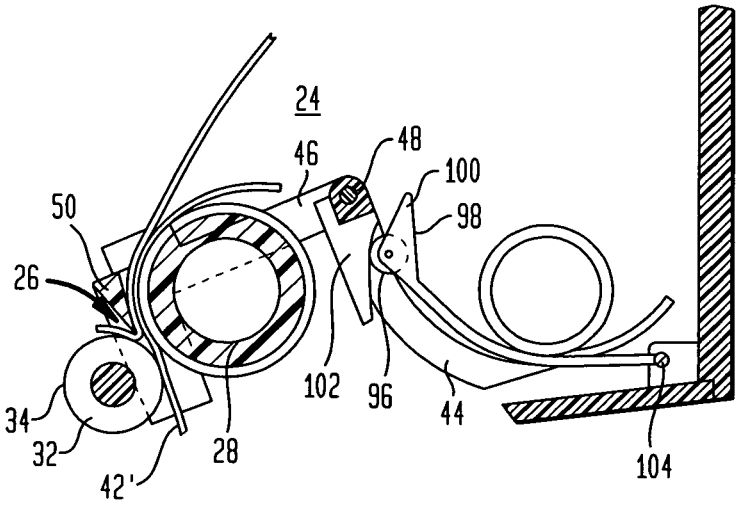

The cradle and the lever member are configured as shown, such that when the cradle supports a roll of paper towel that has not been substantially depleted, the tucker element is raised above the dispensing nip as shown in FIG. 6. When a roll disposed on the cradle has been substantially depleted or the absence of a roll of towel on the cradle, the tucker element advances downwardly toward the dispensing nip in order to introduce paper towel thereto as is shown in FIG. 7.

This action is known in the art as is shown for example in the above-mentioned U.S. Pat. No. 4,807,824 to Gains et al., the disclosure of which has been incorporated herein.

The drive roll is mounted for rotation about a driveshaft mounted in a one-way clutch bearing as is further discussed below.

A vertically oriented press bar assembly 52 with an upper press bar assembly portion 54 is mounted pivotably about its upper portion for inward and outward motion with respect to enclosure 14. Vertically oriented press bar assembly 52 includes at its lower portion 56 a molded-in rack 58 which engages pinion 60 coupled to drive roll 28 by way of a one-way clutch bearing 70 and a driveshaft 62. Driveshaft 62 is mounted in the one-way clutch bearing 70 which has pinion 60 secured (preferably press-fit) thereabout such that the driveshaft advances only when the press-bar assembly is being pushed inwardly from its rest position as will be appreciated from the various Figures. The one-way clutch bearing is preferably a needle clutch bearing as noted above. One-way clutch bearings and their application are further discussed in U.S. Pat. No. 4,635,771 to Shoji et al; U.S. Pat. No. 5,655,722 to Muckridge; as well as U.S. Pat. No. 6,336,542 to Mintonye, II, the disclosures of which are hereby incorporated by reference. As used herein the term "lower portion" of the press bar assembly refers to the fact that rack 58 is located toward the lower extremity of the press bar assembly as shown in the drawing. That is to say, the rack is vertically more than half way toward the bottom of the press bar assembly 52 and preferably more than about 65% of the distance from top 66 to bottom 68 of the press bar towards its lower portion in order to maximize mechanical advantage. A particularly preferred embodiment includes a unitary support member 72 with a molded-in rack as seen particularly in FIG. 4. Member 72 may include a plurality of tabs 74, 76, for example, to receive a press bar handle 78.

Handle 78 is coupled to the drive roll via press bar assembly 52 and driveshaft 62 such that the drive roll will advance web 42' through dispensing nip 26 upon pivotable motion of press bar assembly 52 about its pivot point indicated at 80.

There is further provided a spring 82 to bias the press bar towards the front of the dispenser such that the press bar projects outwardly therefrom in a rest position as shown in FIG. 1. That is to say spring 82 biases the press bar assembly 52 to its rest position, whereas upon inward motion of the press bar assembly, rack 58 engages pinion 60 and drives drive roll 28 to advance the paper as will be appreciated from the drawings. Upon outward motion of assembly 52, rack 58 still engages pinion 60; however, since bearing 70 is a one-way clutch bearing, pinion 60 is freewheeling and does not turn driveshaft 62.

A dispensing chute 84 located below dispensing nip 26 is provided with a lower arcuate shelf 86 configured to direct web 42' forwardly toward front portion 16 of dispenser 10.

A cutting blade 90 is disposed below the dispensing nip above lower shelf 86 of dispensing chute 84.

It should be noted that nip roll 32 defines the second friction surface 34 of dispensing nip 26 at a lateral portion 92 of the dispenser. This location is generally at a lateral extremity 94 of dispensing nip 26 adjacent a sidewall 18 of the dispenser, preferably between disks 36 as shown. Tucker element 50 is located adjacent this lateral friction surface to provide for feeding a reserve roll of paper towel. There is additionally provided a damper mechanism 98 coupled to lever member 46 wherein damper mechanism 98 includes a cam 100 mounted for pivotable movement as well as a cam follower 102. Cam 100 is mounted for rotational movement about a pivot 104 with the tucker element coupled to follower 102 as shown. The cam is positioned as shown such that cam 100 engages sheet material 42' as it is dispensed from cradle 44 with the result that the force of sheet material 42' is transferred by the cam to the cam follower by a roller 96 such that tucker element 50 is maintained in the raised position shown in FIG. 6. This feature is provided so that the reserve roll is not fed to the dispensing nip until the primary roll is exhausted, whereupon tucker element 50 descends to the position shown in FIG. 7 to feed the reserve roll to dispensing nip 26.

Preferably rack 58 is an internal rack configured to engage the pinion along a lower circumferential position 105 with respect to an axis of rotation 106 of the pinion, which is the same as the axis of driveshaft 62. That is to say, rack 58 generally has a radius of curvature whose center is on the same side of the rack as the gear teeth thereof. As noted above clutch bearing 70 is preferably a one-way needle clutch bearing. An appropriate clutch bearing is Model No. HFZ 640 708E available from INA of Germany.

Lower shelf 86 of dispensing chute 84 extends forwardly with respect to cutting blade 90 over a distance 108 such that a line between an outer lip 110 of shelf 86 and cutting blade 90 makes an angle 91 of at least about 25° with respect to a vertical 93. Preferably that angle is at least about 30° with respect to the vertical, shown schematically in FIG. 2(*a*). This feature is important to prevent unwanted dispensing inasmuch as the clutch bearing is only locked upon inward motion of the press bar. So also, press bar assembly 52 comprises the unitary support member 72 with the molded-in rack 58, and press bar handle 78 is preferably press fit to the support member, whereas chute 84 has a plurality of optional ridges 85 to reduce static.

There is shown in FIGS. 8 through 11 another embodiment of the present invention.

Figure 8:
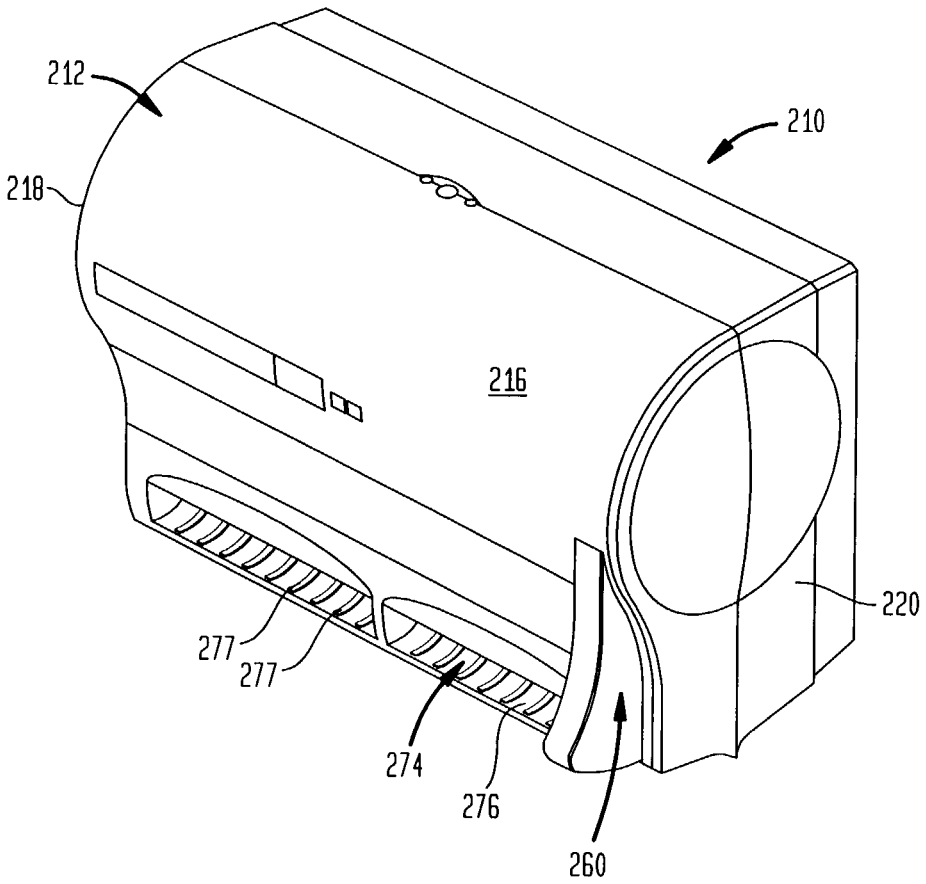
FIG. 8 is a perspective view of another embodiment of a towel dispenser which may be constructed in accordance with the present invention.

FIG. 8 is a perspective view of a double side-by-side dispenser 210 wherein rolls of paper towel to be dispensed are mounted in co-axial side-by-side position for sequential dispensing. In FIGS. 8-11 parts corresponding to those in FIGS. 1-7 are sometimes numbered 200 numerals higher for convenience. Dispenser 210 includes a housing 212 defining an enclosure 214 with an enclosure front portion 216 and enclosure sidewall portions 218 and 220 and enclosure upper and lower portions 222 and 224. A first dispensing nip 226 in lower portion of housing 212 is defined in part by a first drive roll 228 and further includes a passive nip roll 230. A second nip 232 in the lower portion of the housing is defined in part by a second drive roll 234 and further includes a second nip roll 236. As can be seen from the various figures first and second dispensing nips 226 and 232 are generally co-axial lined with respect to one another. So also there are provided mounting hubs such as hubs 238, 240 for rotatably mounting first and second rolls of paper towel in upper portion 222 of enclosure 214 such that rolls such as roll 242 are co-axially aligned such that the towel may be fed downwardly therefrom to first and second dispensing nips 226 and 232, respectively.

First drive roll 228 and second drive roll 234 of dispensing nips 226 and 232 are rotatably mounted at 244-250. There is further provided a rotatable driveshaft 252 mounted in a one-way clutch bearing 275 which has a drive pinion 256 secured thereabout. Rotatable driveshaft 252 is coupled to an elongate metal shaft 253 extending through both drive rolls 228 and 234 and is selectively coupled thereto as described further below.

A vertically oriented press bar assembly 260 with an upper press bar assembly portion 262 is pivotably mounted about an axis indicated at 264 for inward and outward motion with respect to said enclosure 214. Press bar assembly 260 includes at its lower portion 266 a rack at location 268 which engages pinion 256 which, in turn, is coupled to driveshaft 252. Driveshaft 252 thus rotates upon pivotal motion of the press bar by virtue of the fact it is coupled thereto by way of pinion 256 as will be appreciated by one of skill in the art because the one-way bearing imparts rotation only upon inward motion of the press bar since the bearing rotates freely upon return of the press bar to its rest position. In other words, the drive mechanism generates substantially the same as discussed in connection with dispenser 10 above.

Figure 9:
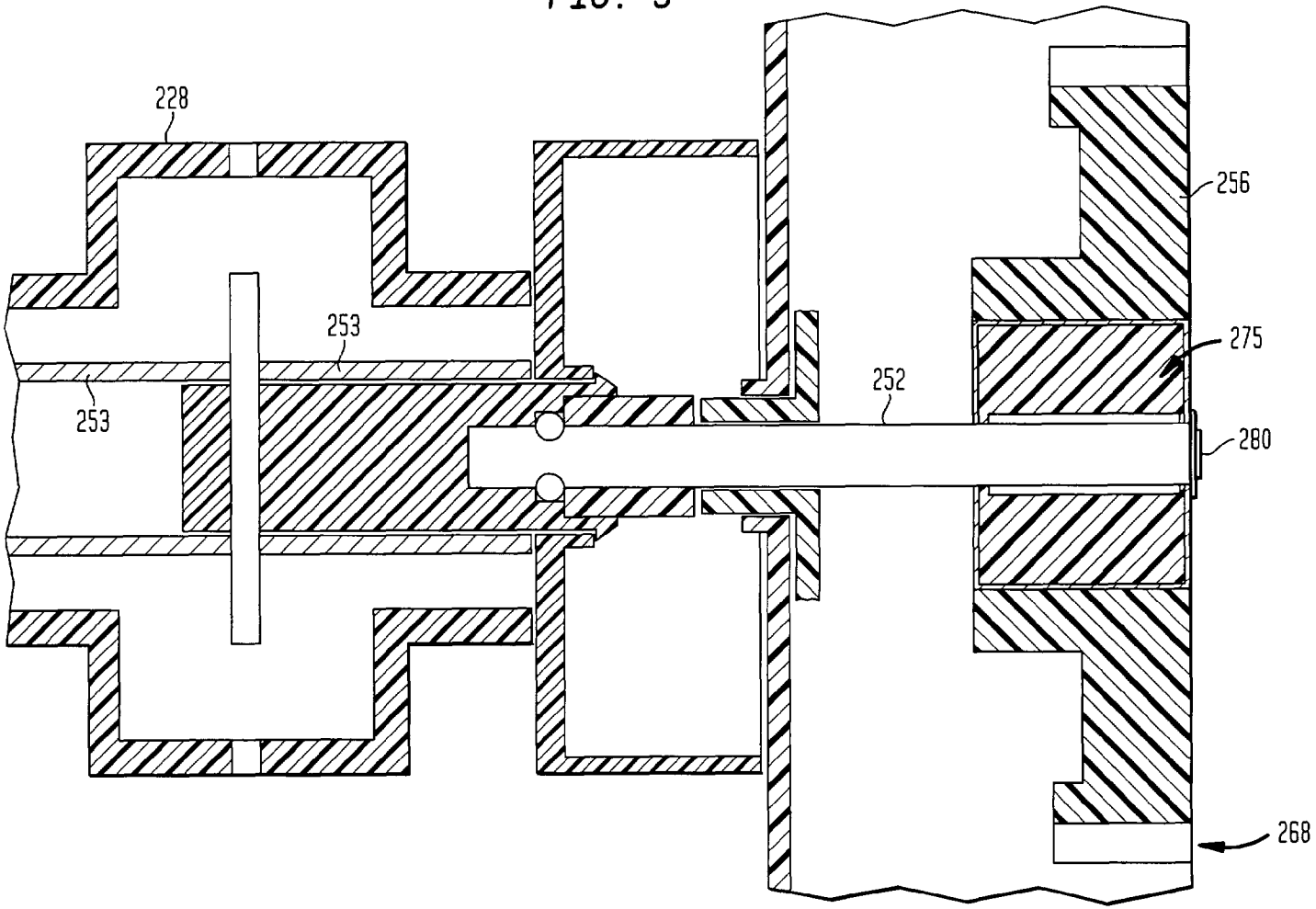
FIG. 9 illustrates the drive mechanism for rotating the drive roll of a dispenser of the class shown in FIG. 8.
Figure 10:
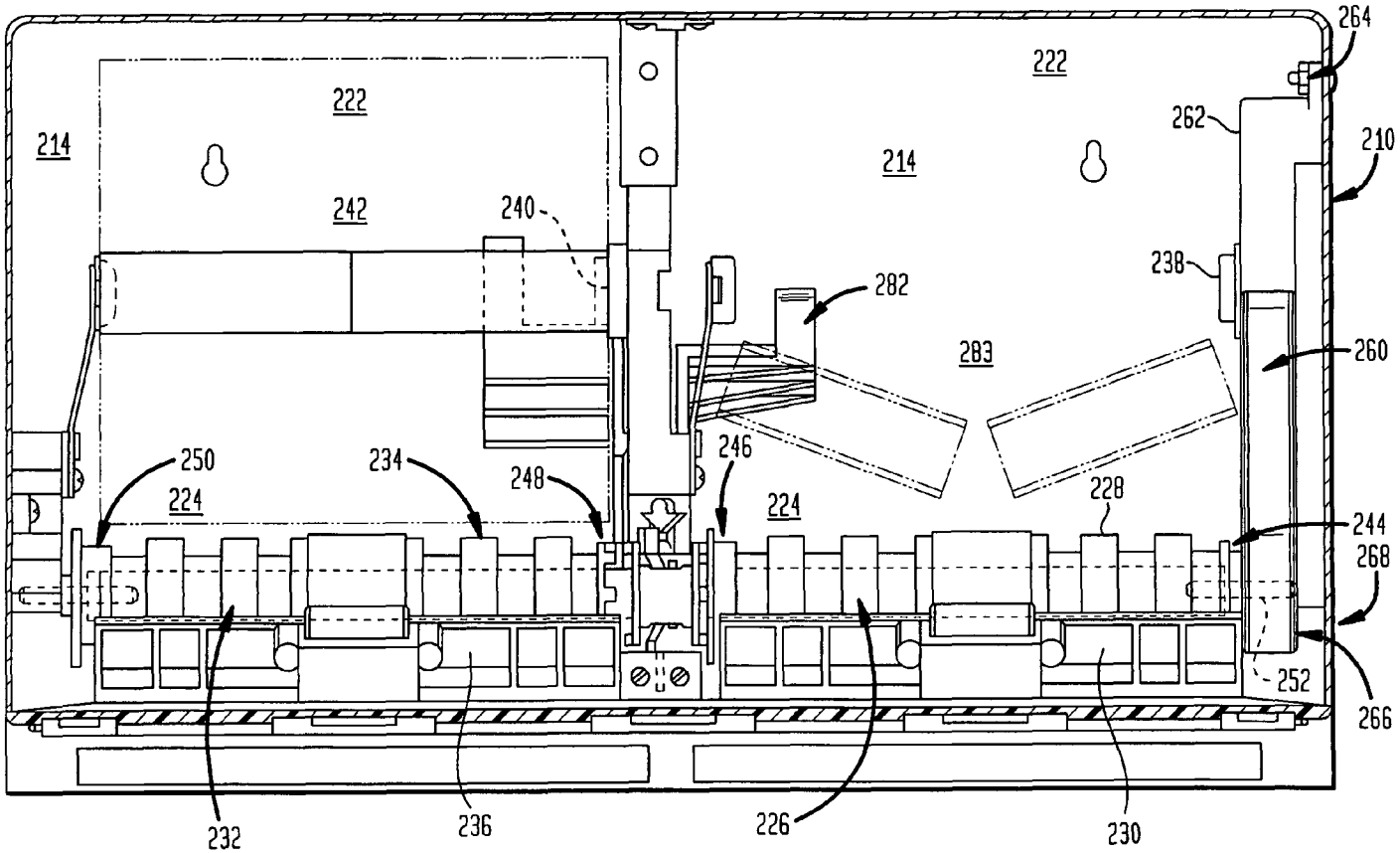
FIG. 10 is a schematic front view in elevation of the interior of the dispenser of FIG. 8.
Figure 11:
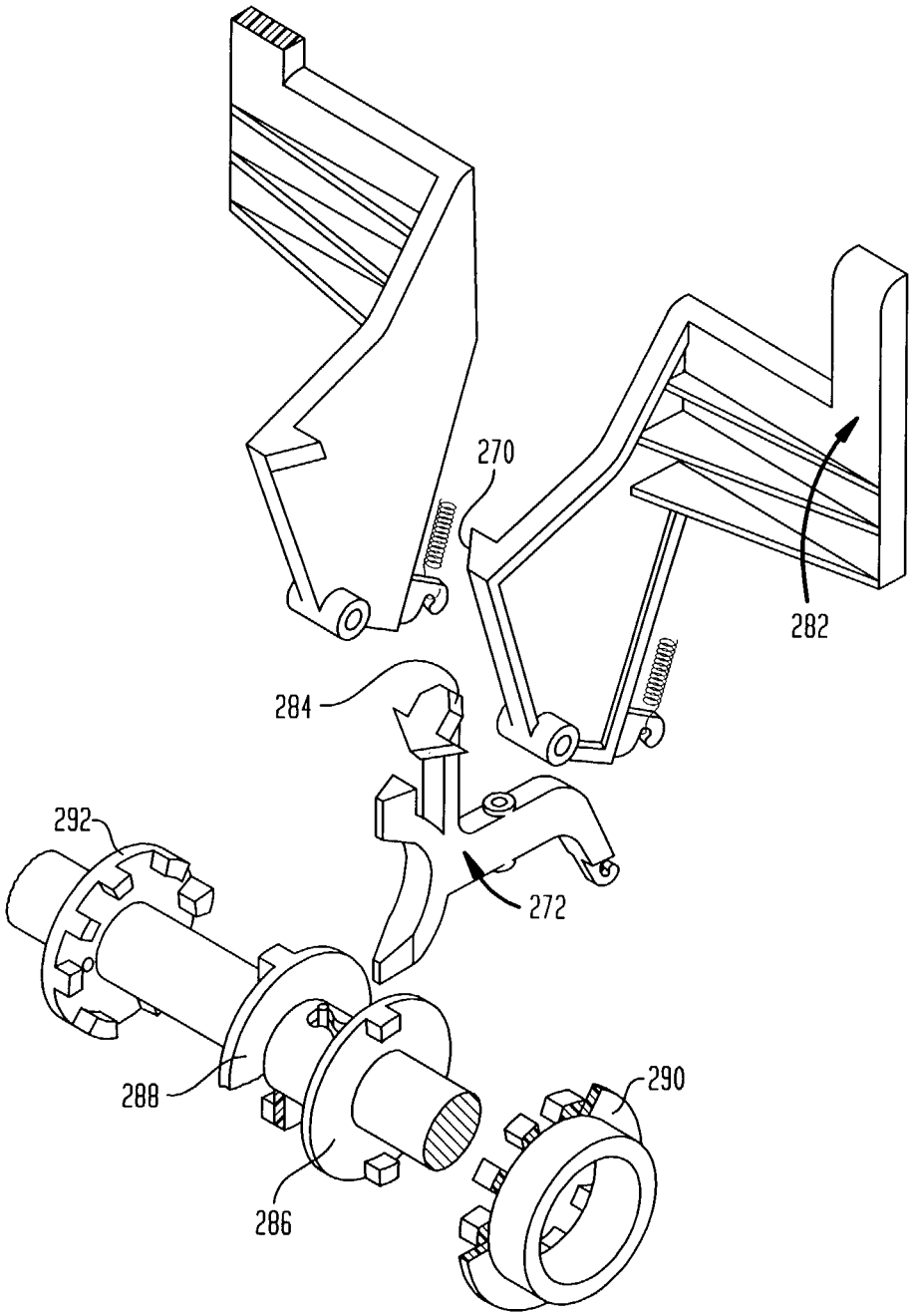
FIG. 11 illustrates a sensor drive transfer mechanism with a yoke adapted to alternately couple respective drive rolls of the dispenser of FIGS. 8-10 to a driveshaft of the dispenser.

The driveshaft is selectively coupled to either first drive roll 228 or second drive roll 234 such that the dispenser is adapted to sequentially dispense paper towel from first roll 242 and upon depletion thereof, from a second roll. This may be accomplished by any suitable means such as by way of sensor arms which include a cam surface 270 which activates yoke 272 to switch the dispenser from one roll to the other as is known in the art and is shown in the various diagrams. A spring loaded sensor arm such as arm 282 will engage a roll of split-core towel and be retained backwardly when the roll is being dispensed. When the split core towel is depleted and the core falls from its retaining bearings, arm 282 is biased so that it swings forwardly as shown in FIG. 10 at 283, so that cam surface 270 engages a corresponding cam surface 284 on yoke 272. Yoke 272 (FIG. 11) selectively moves clutch members such as clutch members 286, 288 into engagement with drive plates 290, 292 which, in turn, drive either one or the other off the drive rolls of the dispenser. That is, clutch members 286, 288 are coupled to tubular drive rod 253 which coaxially runs along the length of both roll 228 and 234 and is coupled to driveshaft 252 as shown in FIG. 9.

Here again means for biasing press bar assembly 260 toward front portion 216 of dispenser enclosure 214 includes a spring as noted above in connection with the embodiment of FIGS. 1 through 7.

A dispensing chute 274 located below dispensing nip 226 with a lower shelf 276 is configured to direct the web forwardly towards the front portion of the dispenser as shown. Optionally provided are ridges 277. A cutting blade is here again disposed below the dispensing nips and above lower shelf 276 of dispensing chute 274. So also, the rack at 268 is preferably an internal gear rack having a radius of curvature upwardly into the enclosure and configured to engage pinion 256 along a lower circumferential position at 268 with respect to an axis of rotation 280 of pinion 256. The one-way clutch bearing 275 is preferably a one-way clutch needle bearing as noted above and the construction and arrangement of chute 274 and the press bar assembly are as described above in connection with dispenser 10.

Figure 12:
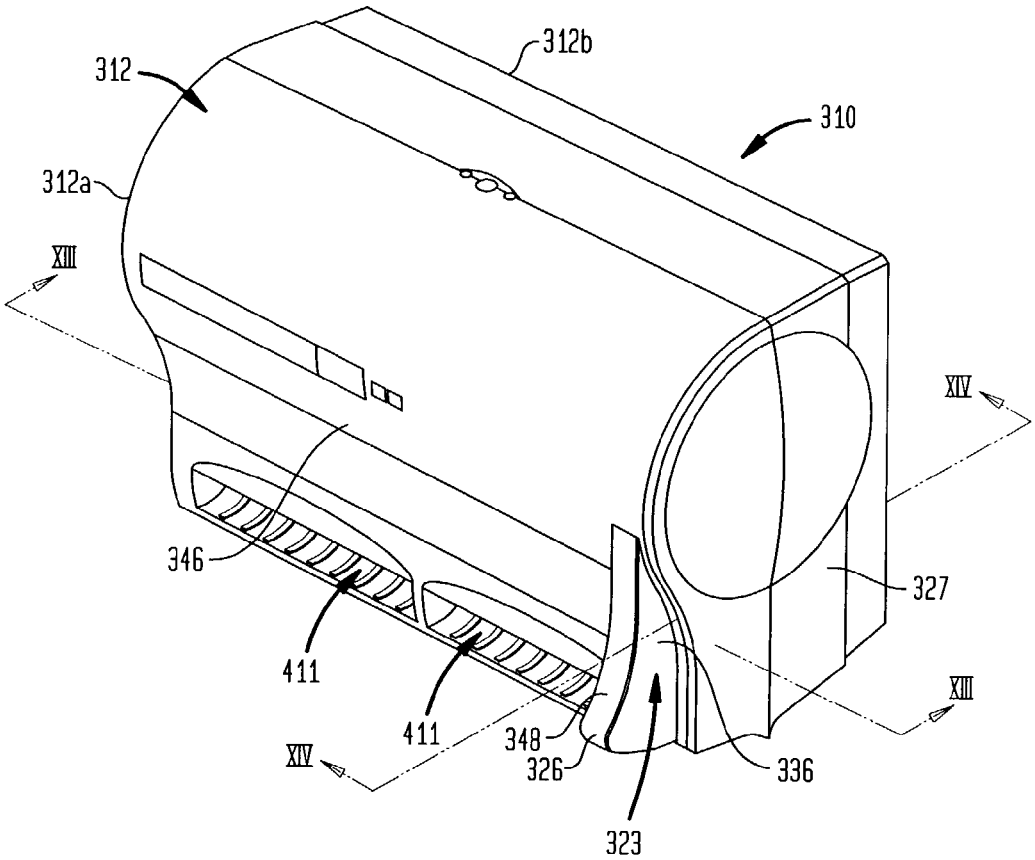
FIG. 12 is a perspective view of yet another dispenser in accordance with the present invention.
Figure 13:
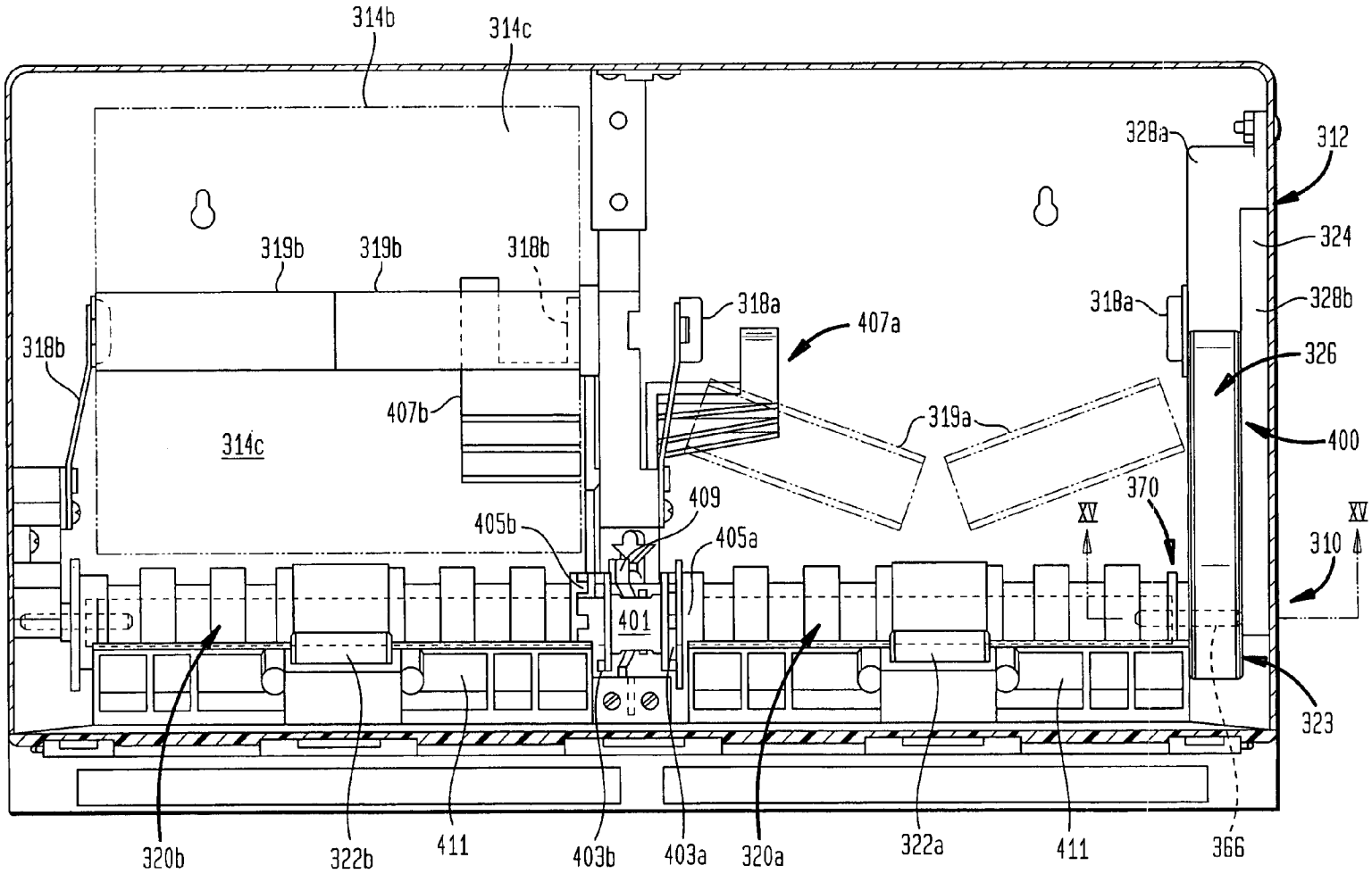
FIG. 13 is a cross-sectional view taken along line XIII-XIII in FIG. 12.
Figure 14:
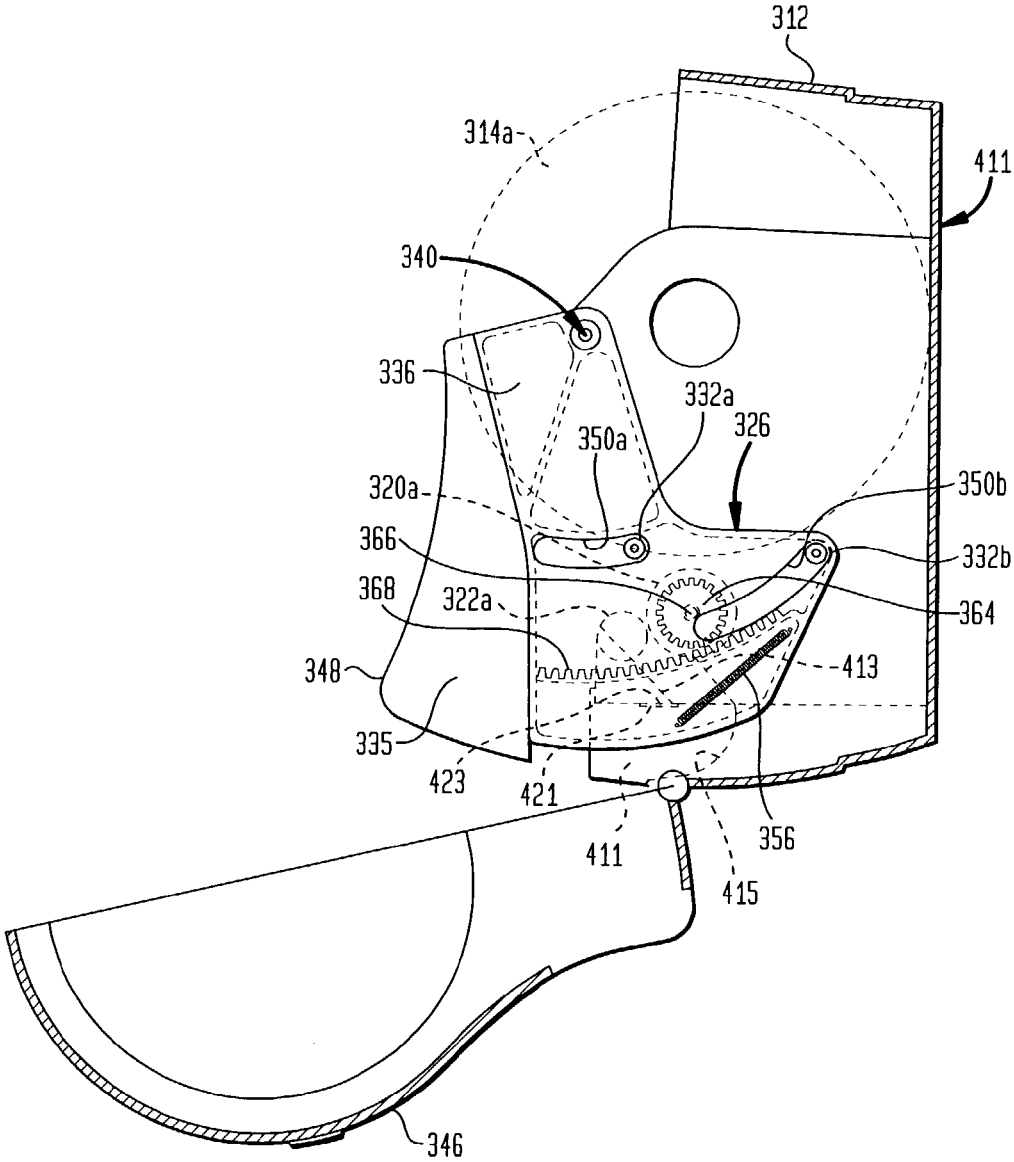
FIG. 14 is a cross-sectional view taken along line XIV-XIV in FIG. 12.

In FIGS. 12 through 25 still yet another dispenser 310 includes a housing 312 having a front housing portion 312*a* and a back housing portion 312*b* and framework 316 that supports and encases a pair of rolls 314*a*, 314*b* side by side (FIG. 13). The rolls each preferably consist of a continuous web of sheet material such as paper toweling, but could be tissue, napkins or other materials that can be easily rolled for subsequent dispensing. Roll supports 318*a*, 318*b* engage roll cores 319*a*, 319*b* to support the rolls for free rotation (FIG. 13). Feed rollers 320*a*, 320*b* and pinch rollers 322*a*, 322*b* extend across the front of the housing for dispensing sheet material to the user. An actuator unit 323 having a casing 324 and an actuator 326 is secured inside one sidewall 327 of housing 312 (FIGS. 12-14).

Casing 324 includes a pair of molded side members 328*a*, 328*b* that each forms half of a container for the actuator. The side members preferably include a plurality of coupling members 330*a*, 330*b* that interconnect to hold the side members securely together. Coupling members 330*a* extend between the side members 328*a*, 328*b* and define apertures for receiving complimentary stem-shaped coupling members 330*b*. An adhesive preferably secures coupling members 330*b* within coupling members 330*a*. Nevertheless, other coupling members and other constructions for interconnecting the side members could be used. At least one pair of the interconnected coupling members 330, and preferably two spaced apart pairs of interconnected coupling members, extend across a mid portion of the casing to at least partially define guides 332*a*, 332*b* to, as described below, provide the push arm with enhanced stability and support.

Figure 16:
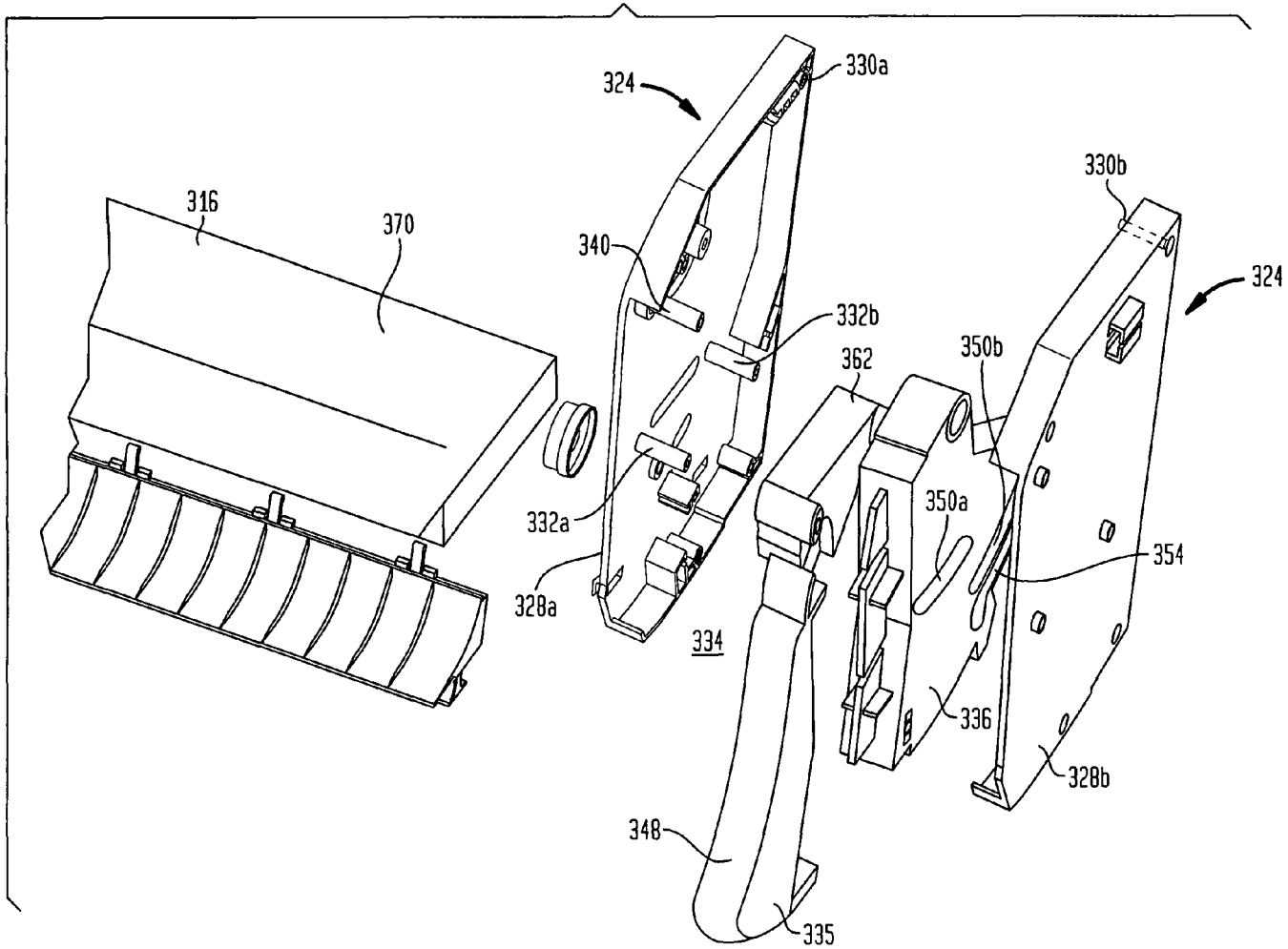
FIG. 16 is an exploded perspective view of an actuator unit and adjoining framework of the dispenser.
Figure 17:
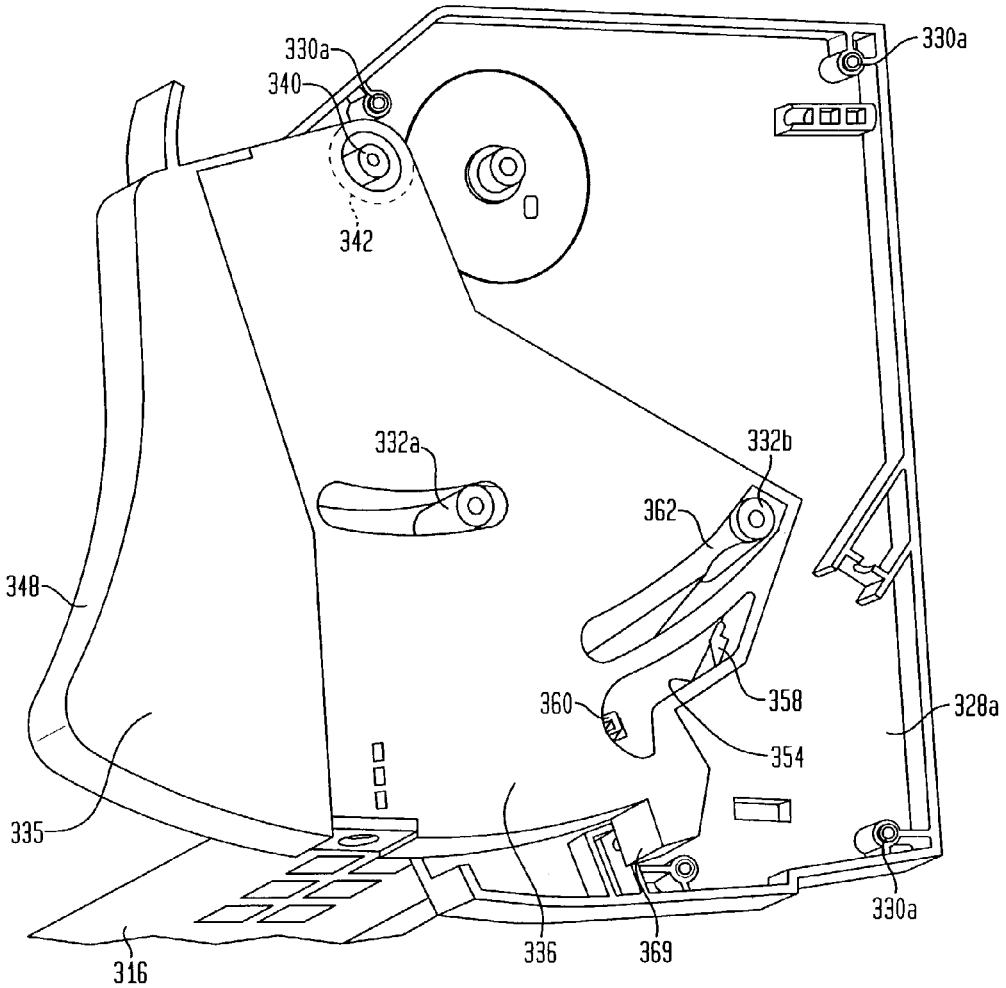
FIG. 17 is a partial perspective view of the interior of the actuator unit.
Figure 23:
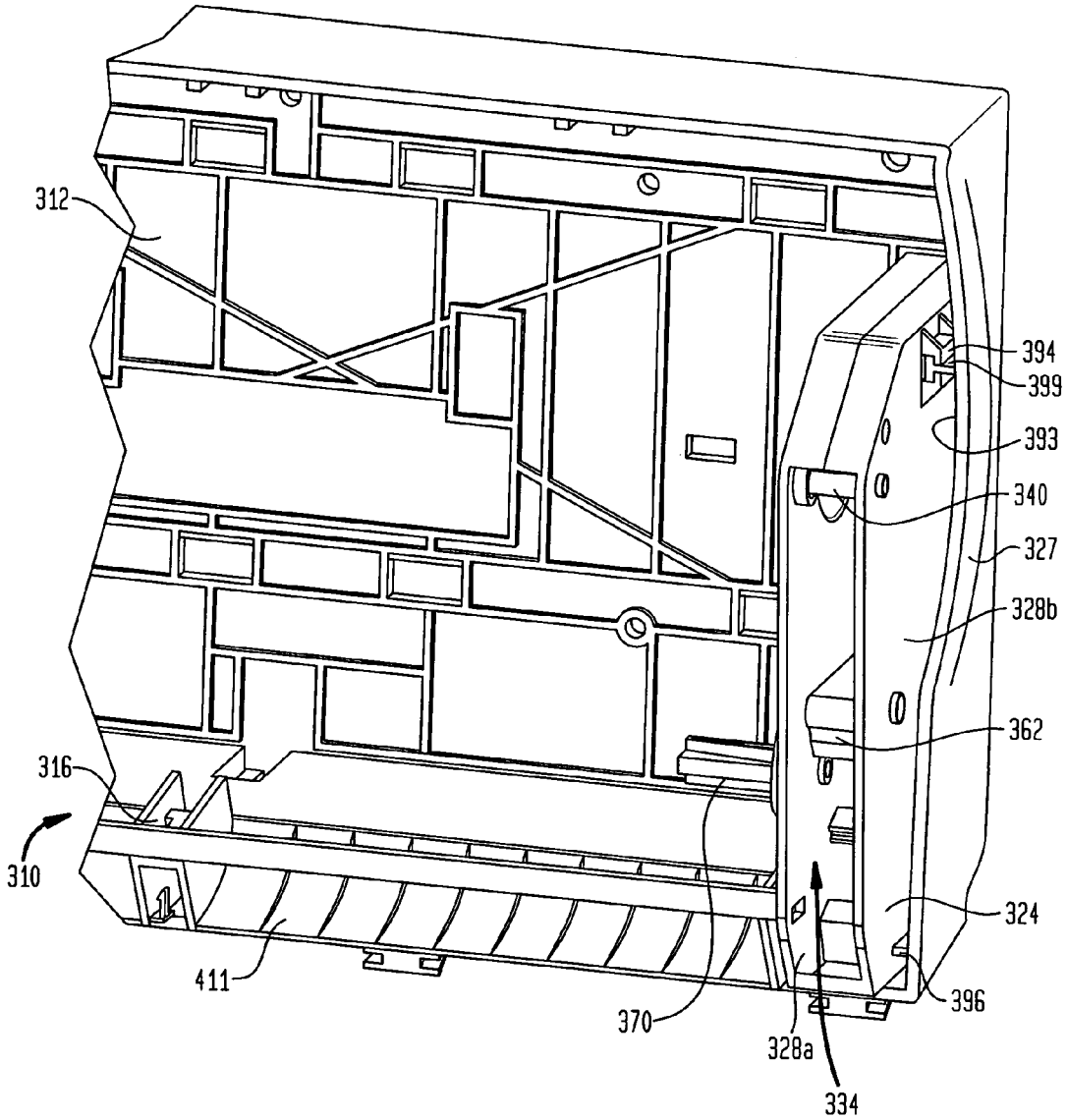
FIG. 23 is a partially assembled dispenser with the casing fit into the housing.

Casing 324 defines an opening 334 along its front side to receive therethrough a contact portion 335 of push arm 336 (FIGS. 12, 16 and 23). Push arm 336 includes a pivot hole 338 that is preferably received over one other of the interconnected coupling members 330 defining a pivot pin 340. A bushing 342 is preferably received over pivot pin 340 for easier swinging of push arm 336 (FIG. 17). Alternatively, the pivot pin could be formed by other means extending between the side members 328*a*, 328*b*. The exterior contact portion 335 projects out the front wall 346 of housing 312 to be operated by the user (FIG. 12). The front face 348 of contact portion 335 is preferably angled outward or provided with a concave curve that extends outward along the bottom to provide an enhanced support for the user and an easy, ergonomical front surface for pushing the push arm inward. Nonetheless, front face 348 could have other shapes if desired.

Figure 18:
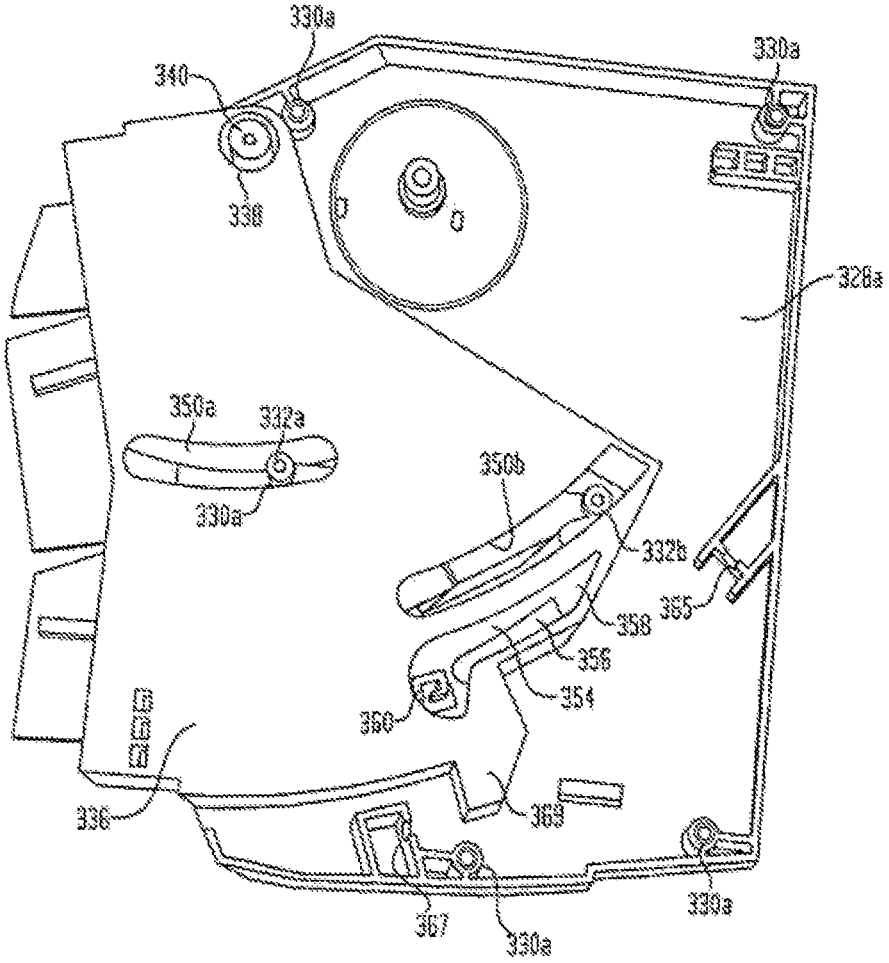
FIG. 18 is a side view of the interior of the actuator with the contact portion of the push arm and the drive gear support omitted.

Push arm 336 further includes at least one slot, and preferably two spaced apart slots 350*a*, 350*b*, for receiving guides 332*a*, 332*b* (FIGS. 16-18). As the push arm swings inward under pressure by the user, guides 332*a*, 332*b* slide along the length of slots 350*a*, 350*b*. The guides, then, stabilize the motion of the push arm for a more even swinging action so that the push arm is unlikely to stick, become jammed, or break. The provision of the guides within the slots helps to support the push arm and lessen the stresses that may develop within the push arm during use. While using guides such as those shown at 332*a*, 332*b* is preferred for economy and ease of manufacture, the guides could be formed by other means.

In the preferred construction, push arm 336 also includes an elongated opening 354 for receiving a spring 356 (FIG. 14). More specifically, spring 356 is attached to a hook 358 fixed to push arm 336 at the rear end of opening 354 and a hook 360 fixed to side member 328*a* (or side member 328*b*). When push arm 336 is depressed, spring 356 is stretched to bias the push arm back to its projecting rest position for another actuation. The spring could be positioned elsewhere within casing 324 so long as it naturally biases the push arm to the projecting rest position when the user releases the push arm.

Figure 15:
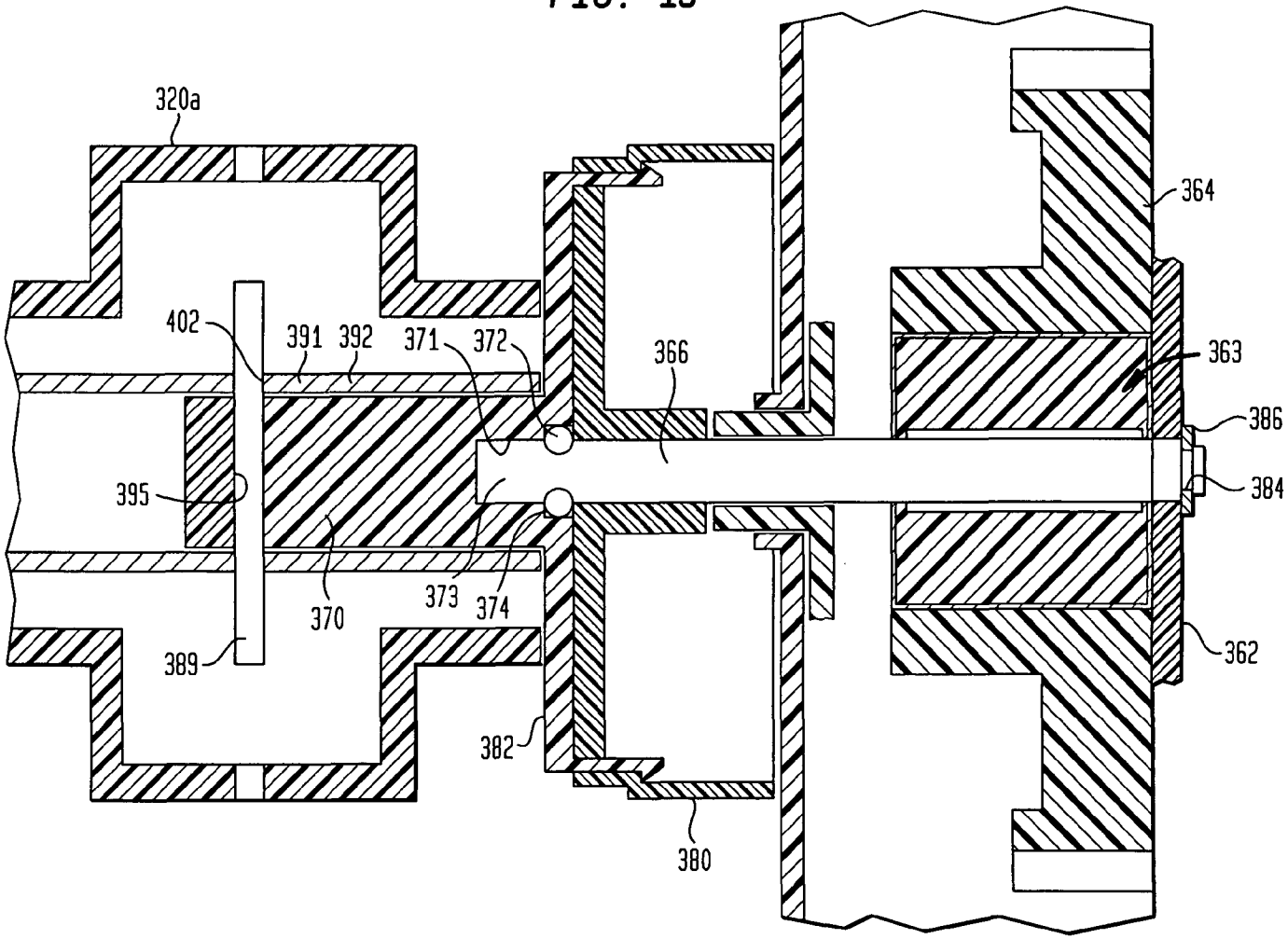
FIG. 15 is a cross-sectional view taken along line XV-XV in FIG. 13.

Push arm 336 is preferably hollow to receive therein a support 362 for a drive gear 364 (FIG. 15 and following). In the preferred construction, support 362 is stabilized by guides 332*a*, 332*b* and a driveshaft 366. As seen in FIG. 17, guides 332*a*, 332*b*, in a preferred construction, are slightly undersized relative to slots 350*a*, 350*b* because support 362 is received over the guides and fill the clearance between the guides and slots.

Drive gear 364 is exposed along the bottom of support 362 to engage a rack 368 fixed to push arm 336. In the rest position of push arm 336, drive gear 364 engages the rear end of rack 368 (FIG. 14). As the push arm is depressed, rack 368 translates rearward to rotate drive gear 364. Drive gear 364 is secured to driveshaft 366 via a conventional one-way bearing 363. The one-way bearing rotates driveshaft 366 with drive gear 364 when the push arm 336 is depressed, but permits the drive gear to rotate freely on driveshaft 366 when the push arm moves forward under the bias of spring 356. Such bearings are available from INA (Germany), a suitable bearing being INA Model No. HFZ 040 708E as noted above. Other one-way bearings are disclosed in U.S. Pat. No. 4,635,771 to Shoji et al., U.S. Pat. No. 5,655,722 to Muckridge, and U.S. Pat. No. 6,336,542 to Mintonye, II, all of which are herein incorporated by reference. Other orientations of the drive gear and rack are possible. A rear stop 365, preferably composed of rubber or other elastomer, is secured to side member 328*a* (or 328*b*) to abut the push arm and define a fixed end to its swinging motion when depressed. Similarly, a front stop 367 abuts a ledge 369 on push arm to set the projection, rest position for push arm 336.

Driveshaft 366 is coupled to drive stem 370 so that the drive stem rotates with the driveshaft. Specifically, in the preferred construction, drive stem 370 includes a hole 371 for receiving one end 373 of driveshaft 366. Detents 372 on driveshaft 366 are received within pockets 374 adjacent hole 371. A cap 380 is secured to the base 382 of drive stem 370 to hold detents 372 in pockets 374 and prevent release of driveshaft 366 from drive stem 370. A groove 384 is formed on the free end of driveshaft 366 for receiving a clip 386 for securing the driveshaft to support 362. One end 391 of an elongate shaft 392 for driving the feed rollers is fit over drive stem 370 and secured thereto by a press pin 389 in hole 395 and a corresponding hole 402 in the elongate shaft 392 (FIG. 15). Nevertheless, other coupling arrangements could be used.

Figure 24:
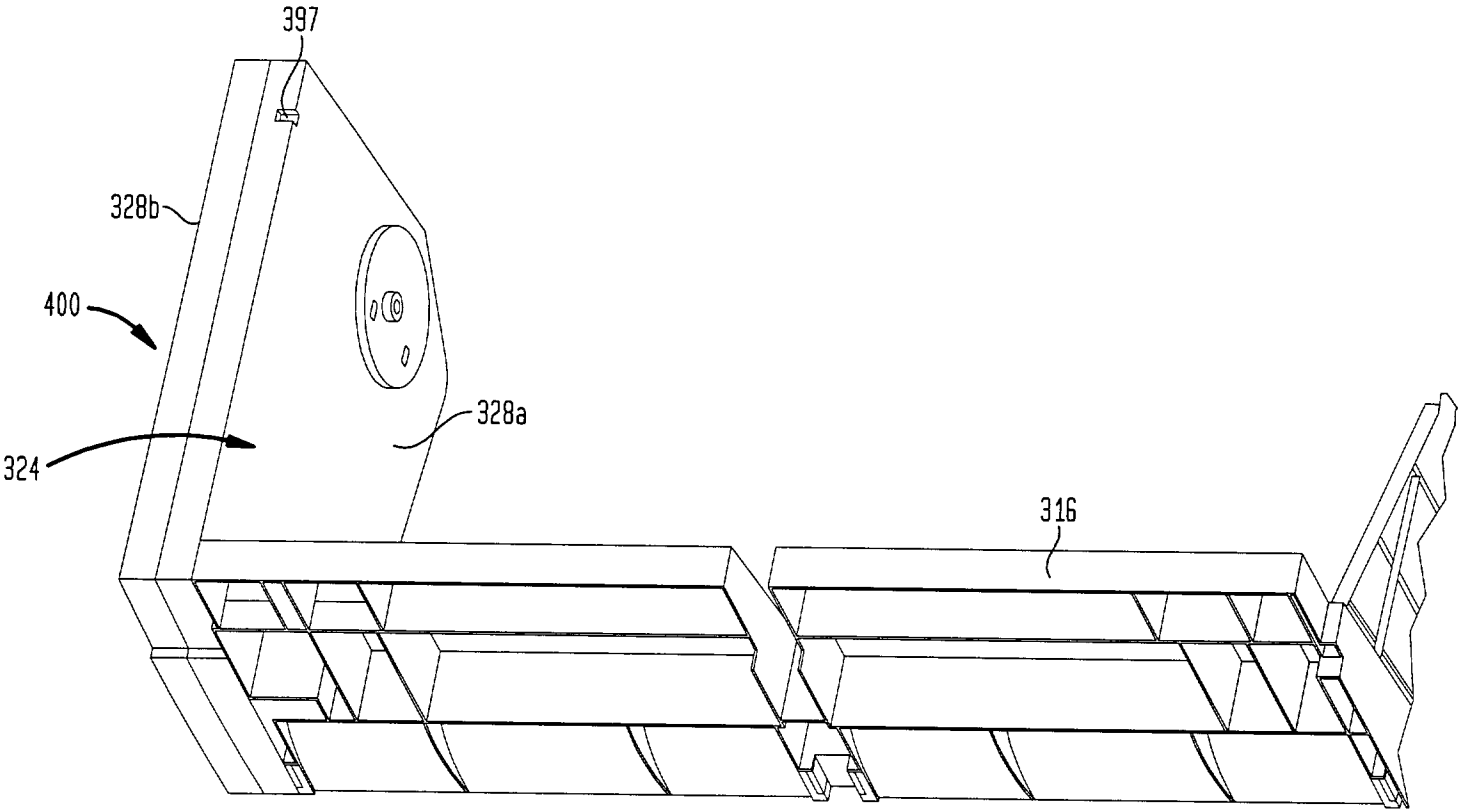
FIG. 24 is a perspective view of the rear of the dispenser framework illustrating the attachment of the casing in the housing.
Figure 25:
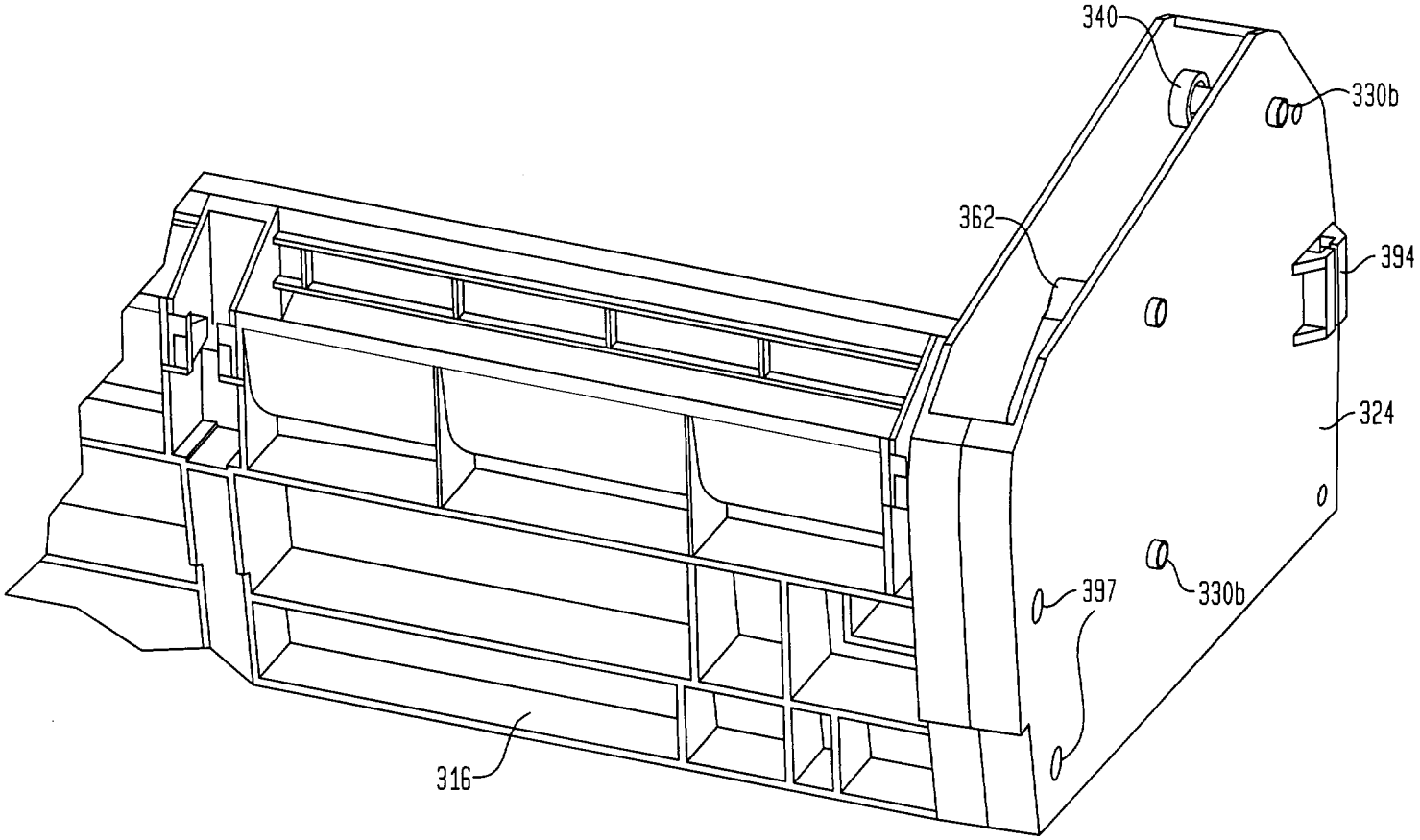
FIG. 25 is a perspective view of a side of the dispenser framework illustrating the attachment of the casing in the housing.

Casing 324 and actuator 326 define a self-contained actuator unit 400 that can be easily assembled into housing 312 for an easy, quick and economical manufacture of the dispenser (FIGS. 23-25). Specifically in the preferred construction, the outer sidewall 328*b* of casing 324 defines a T-shaped groove 394 that slideably receives a complementary tongue 399 formed on the inner surface of sidewall 327 when the casing is inserted into the housing to hold the casing against sidewall 327; although the groove and tongue could be reversed, replaced with grooves and tongues having other shapes (e.g., dovetail) so long as their interconnection holds the casing to the housing, and/or moved to hold the casing to a different part of the housing. In any event, the casing is simply slid into the housing to preliminarily retain the actuator unit within the housing. A rib is preferably provided along a bottom portion of housing 312 to ensure proper positioning of the casing 324. A single screw (not shown) passed through housing 312 and secured within opening 397 on a rear side of the casing is all that is needed to hold the casing within housing 312. Nonetheless, two additional screws are preferably passed through holes 397 to secure the casing to framework 316 (FIGS. 24, 25). Further, additional screws, screws extending through sidewall 327 or other parts of the housing, other latching means, and/or other fasteners could be used to secure casing 324 within housing 312. The separate construction of actuator unit 400 and then fitting the actuator unit as a whole into the housing is easier, quicker and cheaper than assembly of the various components individually to the housing framework. Once the actuator unit is secured in the housing, the elongate shaft 392 can be coupled to the drive stem 270.

The successive operation of feed rollers 320*a*, 320*b* by the elongate shaft is as disclosed in U.S. Pat. No. 4,260,117 to Perrin et al., which is hereby incorporated by reference. In general, elongate shaft 392 extends across the front of the dispenser within feed rollers 320*a*, 320*b* (FIGS. 13, 15). A spool 401 (FIG. 13) is encompassed about elongate shaft 392 in a central location between feed rollers 320*a*, 320*b*. The spool is secured to the elongate shaft so that the spool rotates with the elongate shaft, but can axially move along the elongate shaft. Spool 401 has teeth 403*a*, 403*b* on either end that selectively engage complementary teeth 405*a*, 405*b* on the end of either feed roller 320*a*, 320*b*. The spool shifts axially along elongate shaft 392 so that the spool engages only one of the feed rollers at a time. With spool 401 engaged with, for example, feed roller 320*a*, rotation of elongate shaft 392 (by depression of push arm 336) drives feed roller 320*a* to dispense a length of the paper (depending on the extent of the depression of the push arm). This action continues until roll 314*a* is exhausted.

Cores 319*a*, 319*b* of rolls 314*a*, 314*b* are each split so as to break apart and fall out of roll supports 318*a*, 318*b* when the sheet material is exhausted. A spring-biased paddle 407*a*, 407*b* is biased to set against each roll 314*a*, 314*b* until the roll is depleted. Once the roll is depleted, the paddle will break the core apart if it does not split apart naturally. A lower portion of each paddle 407*a*, 407*b* includes a cam that pushes spring-biased arms 409 coupled to spool 401 between first and second positions. In particular, the arms are shifted past an over-center position as they move from one position to the other. In this way, the arms stay in either position until moved by one of the paddles 407*a*, 407*b*. The shifting of arms 409 functions to move spool 401 into engagement with either feed roller 320*a* or feed roller 320*b*.

Figure 19:
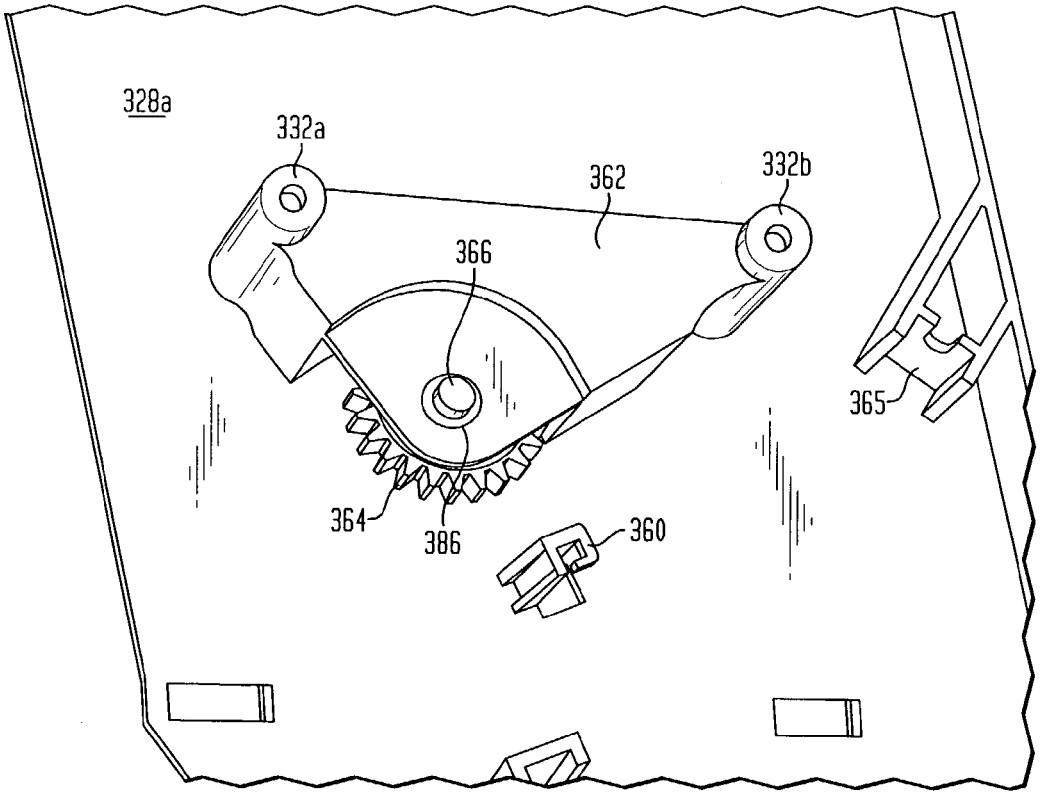
FIG. 19 is a partial perspective view of the side member supporting the drive gear.
Figure 20:
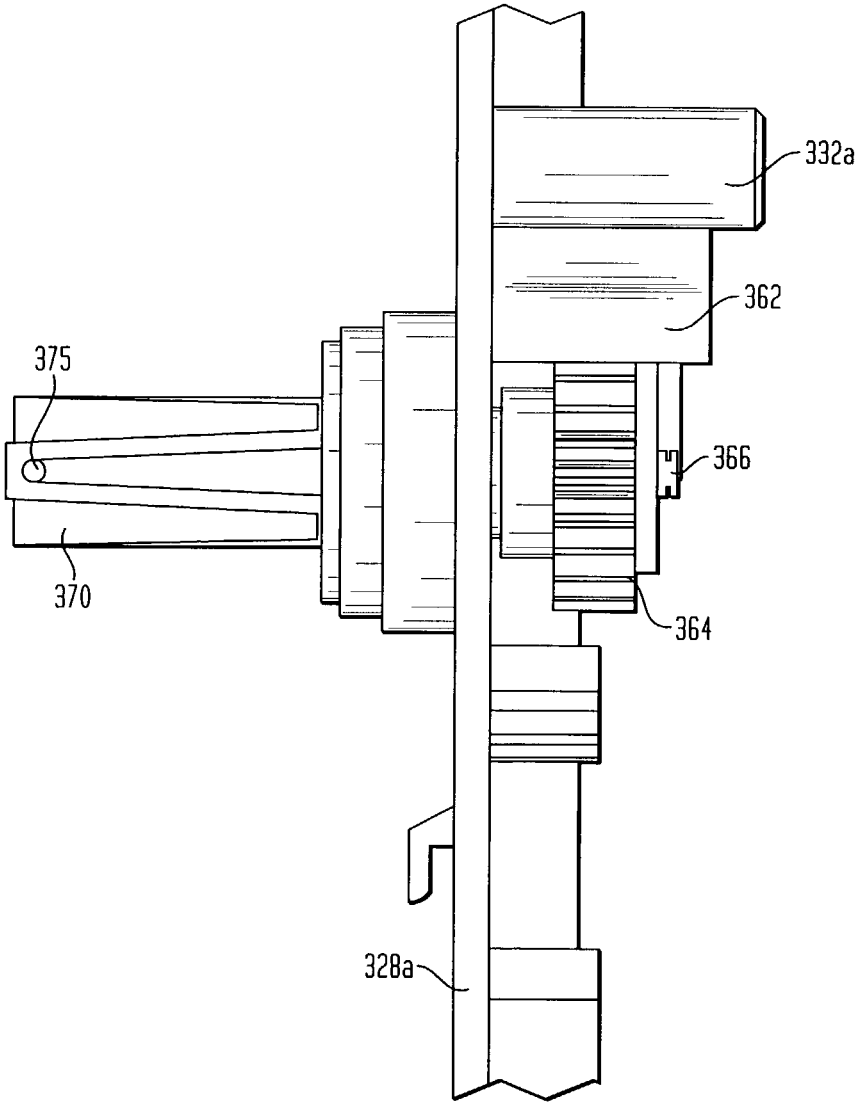
FIG. 20 is a side view of a drive unit secured to a side member of the casing.
Figure 21:
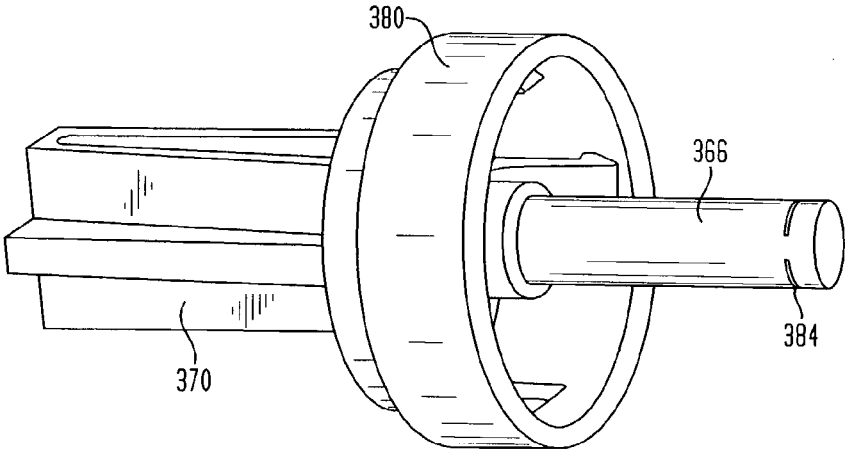
FIG. 21 is a perspective view of an assembled driveshaft and drive stem of the present invention.
Figure 22:
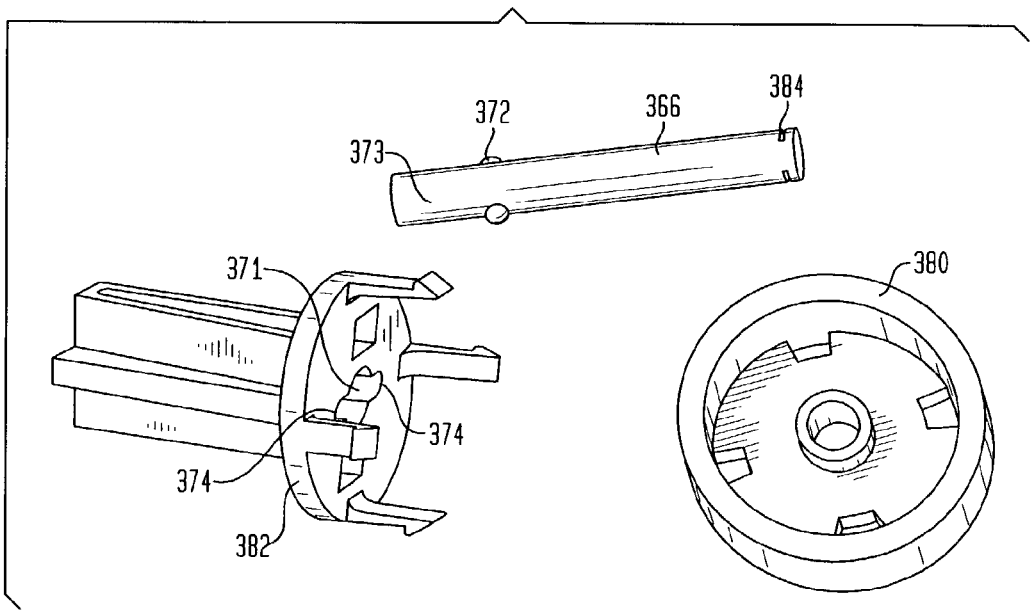
FIG. 22 is an exploded perspective view of the driveshaft and drive stem.

Accordingly, in one example arms 409 are in a first position with spool 401 engaged with feed roller 320*a*. Depression of push arm 336 causes rotation of drive gear 364. The one-way bearing supporting the drive gear causes rotation of driveshaft 366, which via drive stem 370, rotates elongate die shaft 392. The elongate shaft rotates spool 401, which in turn rotates feed roller 320*a* for dispensing the sheet material. The rotation ends when depression of the push arm is stopped, i.e., typically when the push arm abuts rear stop 365 (FIG. 19). Dispensing of the sheet material in this way continues until roll 314*a* is exhausted. At this time, core 319*a* falls or is pushed out of supports 318*a* and paddle 407*a* moves downward and shifts arms 409 to its second position. This movement of the arms causes spool 401 to shift from its engagement with feed roller 320*a* to engagement with feed roller 320*b*. The dispenser, then, dispenses sheet material from roll 314*b* until it is exhausted. During the time sheet material is dispensed from roll 314*b*, a maintenance worker will place a new roll in roll supports 318*a* to be ready for dispensing when roll 314*b* is exhausted. In this way, transfer of the feeding operation from one roll to the other can be accomplished in a reliable and easy manner. The users, then are not frustrated with having no sheet material to use until the next maintenance time. Moreover, the maintenance worker is not required to waste the end portions of the rolls by replacing the rolls early.

When the web is dispensed from, for example, roll 314*a* (or roll 314*b*) it passes from the gap between feed roller 320*a* and pinch roller 322*a*, through discharge chute 411 and out of housing 312. The discharge chute 411 preferably has a generally C-shaped configuration with an upstream segment 413 that extends downward and rearward from feed roller 320*a*, and a second segment 415 that extends downward and forward. A cutting blade 421 (FIG. 14) is provided at the inner apex 423 of discharge chute 411 to sever the continuous web into a discrete sheet length for use by the operator of the dispenser. Specifically, when the user pulls on the free end of the dispensed web, the web is pulled taut and against the cutting blade to sever the free end length from the continuous web as noted in connection with the embodiment described above. The position of cutting blade 421 also operates to prevent the user from simply pulling the sheet material from the dispenser once a free end of the sheet material is exposed. In the preferred construction, the blade forms the only means for preventing direct pulling of the sheet material from the dispenser. This is an easy, reliable means, without moving parts, by which to prevent direct pulling by the user. As discussed above, the use of an actuator to feed out a certain length of the toweling tends to limit the usage of the sheet material and minimize waste and abuse of the dispenser.

The C-shaped discharge chute 411 also prevents access to the feed rollers by a user. The position of the cutting blade 421 at the apex of the chute further functions to inhibit one from reaching into the dispenser. Hence, the risk of contamination of the feed rollers is low. While, the cutting blade is preferably the only means for preventing directly pulling of the sheet material from the dispenser, anti-milking means such as disclosed in the '117 patent, or alternatively other means, could be used in addition or in lieu of the cutting blade. If other means are used to inhibit pulling of the paper from the dispenser, the cutting blade could be oriented differently in the dispenser.

While the invention has been described in connection with numerous embodiments, modifications thereto within the spirit and scope of the appended claims, will be apparent to those of skill in the art.

What is claimed is:

1. In a dispenser for dispensing paper towel including a housing defining an enclosure with an enclosure front portion, enclosure sidewall portions and enclosure upper and lower portions, the improvement comprising:

(a) a dispensing nip in the lower portion of said housing defined in part by a drive roller with a first friction surface means and further including a nip-defining member with a second friction surface means;

(b) means for rotatably mounting a roll of paper towel above said dispensing nip and feeding a continuous web of paper towel downwardly whereby said web is gripped between said first and second friction surface means;

(c) a rotatable driveshaft mounted in a one-way clutch bearing coupled to said drive roller and adapted to impart rotational motion thereto, said one-way clutch bearing having a drive pinion secured thereabout;

(d) a vertically oriented press bar with an upper press bar portion as well as a vertically oriented handle having a length greater than its width projecting forwardly from the housing of the dispenser, said handle being mounted with its length extending vertically with respect to the dispenser, said press bar being pivotally mounted about its upper portion at a pivot point for inward and outward rotation with respect to said enclosure and including at its lower portion a rack which engages the pinion coupled to the drive roller wherein said drive roller is adapted to advance said paper towel web through said nip upon pivotal motion of said press bar;

wherein the press bar has a top and a bottom separated by a distance and the rack is disposed more than about 65% of that distance from the top of the press bar toward the bottom of the press bar;

and wherein the press bar and the vertically oriented press bar handle are mounted and configured such that the vertically oriented press bar handle defines a forwardly projecting substantially vertical plane of rotation with the pivot point upon rotation of the press bar thereabout, the rack, the pinion and the vertically oriented press bar handle remaining generally in said forwardly projecting substantially vertical plane of rotation upon inward and outward rotation of the press bar;

and wherein further the vertically oriented press bar handle and vertically oriented press bar are mounted and configured such that the upper portion of the press bar handle is in vertical proximity with the pivot point and the lower portion of the press bar handle is in vertical proximity with the rack so that the force required for operation of the dispenser is generally horizontal, lying within the forwardly projecting substantially vertical plane of rotation;

(e) means for biasing said press bar toward said front portion of said dispenser enclosure such that the press bar projects forwardly therefrom in a rest position;

(f) a dispensing chute located below said dispensing nip with a lower shelf configured to direct said web forwardly toward the front portion of said dispenser enclosure; and (g) a cutting blade disposed below said dispensing nip and above the lower shelf of said dispensing chute.

2. The dispenser according to claim 1, wherein said rack is an internal rack configured to engage the pinion along a lower circumferential position with respect to an axis of rotation of the pinion.

3. The dispenser according to claim 2, wherein said one-way clutch bearing is a one-way clutch needle bearing.

4. The dispenser according to claim 3, wherein said lower shelf of said dispensing chute extends forwardly with respect to said cutting blade over a distance such that a line between an outer lip of the lower shelf and said cutting blade makes an angle of at least about 25 degrees with respect to a vertical.

5. The dispenser according to claim 4, wherein said lower shelf of said dispensing chute extends forwardly with respect to said cutting blade over a distance such that a line between the outer lip of the lower shelf and said cutting blade makes an angle of at least about 30 degrees with respect to a vertical.

6. The dispenser according to claim 1, wherein said press bar assembly comprises a unitary support member with said rack being a molded-in rack.

7. The dispenser according to claim 6, wherein said rack is an internal rack configured to engage the pinion along a lower circumferential position with respect to an axis of rotation of the pinion.

8. The dispenser according to claim 7, wherein said one-way clutch bearing is a one-way clutch needle bearing.

9. The dispenser according to claim 8, wherein said lower shelf of said dispensing chute extends forwardly with respect to said cutting blade over a distance such that a line between an outer lip of the lower shelf and said cutting blade makes an angle of at least about 25 degrees with respect to a vertical.

10. The dispenser according to claim 9, wherein said lower shelf of said dispensing chute extends forwardly with respect to said cutting blade over a distance such that a line between the outer lip of the lower shelf and said cutting blade makes an angle of at least about 30 degrees with respect to a vertical.

11. A towel dispenser for sequentially dispensing a primary roll of paper towel and a reserve roll of paper towel comprising:

(a) a housing defining an enclosure with an enclosure front portion, enclosure sidewall portions and enclosure upper and lower portions;

(b) a dispensing nip in the lower portion of said housing defined in part by a drive roller with a first friction surface means and further including a nip roller with a second friction surface means;

(c) means for rotatably mounting a first roll of paper towel in the upper portion of said enclosure above said dispensing nip and feeding a continuous web of said first roll of paper towel downwardly where said web is gripped between said first and second friction surface means;

(d) a cradle for supporting a second roll of paper towel in the lower portion of said enclosure behind said dispensing nip, said cradle configured so that a web of said second roll may be fed forwardly to said dispensing nip;

(e) a lever member coupled to said cradle and mounted for rotation about a fulcrum wherein the cradle is disposed rearwardly with respect to the fulcrum and the lever member extends forwardly of said fulcrum in the lower portion of said dispenser and includes a tucker element, said cradle and said lever member being adapted such that when said cradle supports said second roll of paper towel which has not been substantially depleted, the tucker element is raised above said dispensing nip and when said second roll has been substantially depleted or in the absence of said second roll of paper towel on said cradle, the tucker element advances downwardly toward said dispensing nip in order to introduce paper towel thereto;

(f) a rotatable driveshaft mounted in a one-way clutch bearing coupled to said drive roller and adapted to impart rotational motion thereto, said one-way clutch bearing having a drive pinion secured thereabout;

(g) a vertically oriented press bar with an upper press bar portion, as well as a vertically oriented handle having a length greater than its width projecting forwardly from the housing of the dispenser, said handle being mounted with its length extending vertically with respect to the dispenser, said press bar being pivotally mounted about its upper portion at a pivot point for inward and outward rotation with respect to said enclosure and including at its lower portion a rack which engages the pinion coupled to the drive roller wherein said drive roller is adapted to advance one of said paper towel webs through said nip upon pivotal motion of said press bar;

wherein the press bar has a top and a bottom separated by a distance and the rack is disposed more than about 65% of that distance from the top of the press bar toward the bottom of the press bar;

and wherein the press bar and the vertically oriented press bar handle are mounted and configured such that the vertically oriented press bar handle defines a forwardly projecting substantially vertical plane of rotation with the pivot point upon rotation of the press bar thereabout, the rack, the pinion and the vertically oriented press bar handle remaining generally in said forwardly projecting substantially vertical plane of rotation upon inward and outward rotation of the press bar; and wherein further the vertically oriented press bar handle and vertically oriented press bar are mounted and configured such that the upper portion of the press bar handle is in vertical proximity with the pivot point and the lower portion of the press bar handle is in vertical proximity with the rack so that the force required for operation of the dispenser is generally horizontal, lying within the forwardly projecting substantially vertical plane of rotation;

(h) means for biasing said press bar toward said front portion of said dispenser enclosure such that the press bar projects forwardly therefrom in a rest position;

(i) a dispensing chute located below said dispensing nip with a lower shelf configured to direct the one paper towel web forwardly toward the front portion of said dispenser enclosure; and (j) a cutting blade disposed below said dispensing nip and above the lower shelf of said dispensing chute.

12. The towel dispenser according to claim 11, wherein said second friction surface means of said nip roller of said dispensing nip defines a lateral friction surface at a lateral extremity of said dispensing nip adjacent a sidewall of said dispenser and wherein said tucker element is located adjacent said lateral friction surface.

13. The towel dispenser according to claim 12, further comprising a damper mechanism coupled to said lever member, said damper mechanism comprising a cam mounted for pivotal movement, a cam follower engaging the cam and mounted for rotational movement with the tucker element, the cam being positioned for engaging sheet material as sheet material is dispensed from the cradle with the result that the force of the sheet material is transferred by the cam to the cam follower such that the tucker element is maintained in the raised position.

14. The towel dispenser according to claim 11, wherein said rack is configured to engage the pinion along a lower circumferential position with respect to an axis of rotation of the pinion, and wherein the rack has a plurality of gear teeth and defines a radius of curvature whose center of curvature is on the same side of the rack as the pinion.

15. The towel dispenser according to claim 14, wherein said one-way clutch bearing is a one-way clutch needle bearing.

16. The towel dispenser according to claim 15 wherein said lower shelf of said dispensing chute extends forwardly with respect to said cutting blade over a distance such that a line between an outer lip of the lower shelf and said cutting blade makes an angle of at least about 25 degrees with respect to a vertical, and wherein further the dispensing nip is disposed upwardly and forwardly with respect to the cutting blade so that the one paper towel web extending from the dispensing nip to the lip of the lower shelf undergoes a direction change at the cutting blade, from a rearward direction above the cutting blade to a forward direction below the cutting blade.

17. The towel dispenser according to claim 16, wherein said lower shelf of said dispensing chute extends forwardly with respect to said cutting blade over a distance such that a line between the outer lip of the lower shelf and said cutting blade makes an angle of at least about 30 degrees with respect to a vertical.

18. The towel dispenser according to claim 11, wherein said press bar comprises a unitary support member and said rack is a molded-in rack disposed at the lower portion of the press bar and integrally formed with the unitary support member.

19. The towel dispenser according to claim 18, wherein said rack is an internal rack configured to engage the pinion along a lower circumferential position with respect to an axis of rotation of the pinion.

20. The towel dispenser according to claim 19, wherein said one-way clutch bearing is a one-way clutch needle bearing.

21. The towel dispenser according to claim 20, wherein said lower shelf of said dispensing chute extends forwardly with respect to said cutting blade over a distance such that a line between an outer lip of the lower shelf and said cutting blade makes an angle of at least about 25 degrees with respect to a vertical.

22. The towel dispenser according to claim 21, wherein said lower shelf of said dispensing chute extends forwardly with respect to said cutting blade over a distance such that a line between the outer lip of the lower shelf and said cutting blade makes an angle of at least about 30 degrees with respect to a vertical.

23. A dispenser for dispensing a continuous web of sheet material from a roll, the dispenser comprising:

a housing;

supports for supporting at least one roll of sheet material within the housing;

a feed roller for dispensing a length of sheet material from the roll to the user;

a drive gear to rotate the feed roller;

a generally vertical press bar, the press bar including a support member with a gear rack as well as a vertically oriented handle having a length greater than its width projecting forwardly from the housing of the dispenser, said handle being mounted with its length extending vertically with respect to the dispenser and being pivotally mounted at a pivot point for swinging about a pivot axis extending through an upper end of the press bar, the press bar being pushed generally into the housing to dispense a length of sheet material, the press bar being connected to a spring to normally bias the press bar to a rest position, the gear rack of the support member of the press bar being positioned, configured and dimensioned to rotate the drive gear as the press bar swings about the pivot axis; and wherein the press bar has a top and a bottom separated by a distance and the rack is disposed more than about 65% of that distance from the top of the press bar toward the bottom of the press bar; and wherein the press bar and the vertically oriented press bar handle are mounted and configured such that the vertically oriented press bar handle defines a forwardly projecting substantially vertical plane of rotation with the pivot point upon rotation of the press bar thereabout, the rack, the drive gear and the vertically oriented press bar handle remaining generally in said forwardly projecting substantially vertical plane of rotation upon inward and outward rotation of the press bar; and wherein further the vertically oriented press bar handle and vertically oriented press bar are mounted and configured such that the upper portion of the press bar handle is in vertical proximity with the pivot point and the lower portion of the press bar handle is in vertical proximity with the rack so that the force required for operation of the dispenser is generally horizontal, lying within the forwardly projecting substantially vertical plane of rotation.

24. The dispenser according to claim 23, wherein the support member of the press bar comprises a unitary support member and said rack is a molded-in rack disposed at the lower portion of the press bar and integrally formed with the support member.

25. The dispenser according to claim 24, wherein the dispenser further includes a casing and the press bar is disposed in the casing such that there is provided a self-contained actuator unit within the housing.

26. The dispenser according to claim 23, wherein the feed roller is coupled to the press bar by way of a one-way clutch bearing.

27. The dispenser according to claim 23, further comprising a cutting blade disposed below the feed roller and a dispensing chute disposed below the cutting blade having a lower shelf, wherein the lower shelf of the dispensing chute extends forwardly with respect to the cutting blade over a distance such that a line between an outer lip of the lower shelf and said cutting blade makes an angle of at least about 25 degrees with respect to a vertical.

28. The dispenser according to claim 27, wherein the lower shelf of the dispensing chute extends forwardly with respect to the cutting blade over a distance such that a line between the outer lip of the lower shelf and said cutting blade makes an angle of at least about 30 degrees with respect to a vertical.

29. A dispenser for dispensing a continuous web of sheet material from a roll, the dispenser comprising:

a housing;

supports for supporting at least one roll of sheet material within the housing;

a feed roller which cooperates with a nip roller for dispensing a length of sheet material from the roll to the user through a dispensing nip;

a drive gear to rotate the feed roller;

a generally vertical press bar, the press bar including a support member with a gear rack as well as a vertically oriented handle having a length greater than its width projecting forwardly from the housing of the dispenser, said handle being mounted with its length extending vertically with respect to the dispenser and being pivotally mounted at a pivot point for swinging about a pivot axis extending through an upper end of the press bar, the press bar being pushed generally into the housing to dispense a length of sheet material, the press bar being connected to a spring to normally bias the press bar to a rest position, the gear rack of the support member of the press bar being positioned, configured and dimensioned to rotate the drive gear as the press bar swings about the pivot axis;

wherein the press bar has a top and a bottom separated by a distance and the rack is disposed more than about 65% of that distance from the top of the press bar toward the bottom of the press bar;

and wherein the press bar and the vertically oriented press bar handle are mounted and configured such that the vertically oriented press bar handle defines a forwardly projecting substantially vertical plane of rotation with the pivot point upon rotation of the press bar thereabout, the rack, the drive gear and the vertically oriented press bar handle remaining generally in said forwardly projecting substantially vertical plane of rotation upon inward and outward rotation of the press bar;

and wherein further the vertically oriented press bar handle and vertically oriented press bar are mounted and configured such that the upper portion of the press bar handle is in vertical proximity with the pivot point and the lower portion of the press bar handle is in vertical proximity with the rack so that the force required for operation of the dispenser is generally horizontal, lying within the forwardly projecting substantially vertical plane of rotation;

a dispensing chute located below said dispensing nip with a lower shelf configured to direct said sheet material forwardly toward a front portion of said dispenser;

a cutting blade disposed below said dispensing nip and above the lower shelf of said dispensing chute; and wherein further the dispensing nip is disposed upwardly and forwardly with respect to the cutting blade so that towel extending from the dispensing nip to an outer lip of the dispensing chute undergoes a direction change at the cutting blade, from a rearward direction above the cutting blade to a forward direction below the cutting blade.

30. A dispenser for dispensing a continuous web of sheet material from a roll, the dispenser comprising:

a housing;

supports for supporting at least one roll of sheet material within the housing;

a feed roller which cooperates with a nip roller for dispensing a length of sheet material from the roll to the user through a dispensing nip;

a drive gear to rotate the feed roller;

a generally vertical press bar, the press bar including a support member with a gear rack as well as a vertically oriented handle having a length greater than its width projecting forwardly from the housing of the dispenser, said handle being mounted with its length extending vertically with respect to the dispenser and being pivotally mounted at a pivot point for swinging about a pivot axis extending through an upper end of the press bar, the press bar being pushed generally into the housing to dispense a length of sheet material, the press bar being connected to a spring to normally bias the press bar to a rest position, the gear rack of the support member of the press bar being positioned, configured and dimensioned to rotate the drive gear as the press bar swings about the pivot axis;

wherein the press bar is coupled to the feed roller by way of a one-way clutch bearing;

a dispensing chute located below said dispensing nip with a lower shelf configured to direct said sheet material forwardly toward a front portion of said dispenser;

a cutting blade disposed below said dispensing nip and above the lower shelf of said dispensing chute;

wherein the lower shelf of the dispensing chute extends forwardly with respect to the cutting blade over a distance such that a line between an outer lip of the lower shelf and the cutting blade makes an angle of at least about 25 degrees with respect to a vertical; and wherein the dispensing nip is disposed upwardly and forwardly with respect to the cutting blade so that the sheet material extending from the dispensing nip to the outer lip of the dispensing chute undergoes a direction change at the cutting blade, from a rearward direction above the cutting blade to a forward direction below the cutting blade; and wherein the press bar and the vertically oriented press bar handle are mounted and configured such that the vertically oriented press bar handle defines a forwardly projecting substantially vertical plane of rotation with the pivot point upon rotation of the press bar thereabout, the rack, the drive gear and the vertically oriented press bar handle remaining generally in said forwardly projecting substantially vertical plane of rotation upon inward and outward rotation of the press bar; and wherein further the vertically oriented press bar handle and vertically oriented press bar are mounted and configured such that the upper portion of the press bar handle is in vertical proximity with the pivot point and the lower portion of the press bar handle is in vertical proximity with the rack so that the force required for operation of the dispenser is generally horizontal, lying within the forwardly projecting substantially vertical plane of rotation.

31. In a dispenser for dispensing paper towel including a housing defining an enclosure with an enclosure front portion, enclosure sidewall portions and enclosure upper and lower portions, the improvement comprising:

(a) a dispensing nip in the lower portion of said housing defined in part by a drive roller with a first friction surface means and further including a nip-defining member with a second friction surface means;

(b) means for rotatably mounting a roll of paper towel above said dispensing nip and feeding a continuous web of paper towel downwardly whereby said web is gripped between said first and second friction surface means;

(c) a rotatable driveshaft mounted in a one-way clutch bearing coupled to said drive roller and adapted to impart rotational motion thereto, said one-way clutch bearing having a drive pinion secured thereabout;

(d) a vertically oriented press bar with an upper press bar portion, as well as a vertically oriented handle having a length greater than its width projecting forwardly from the housing of the dispenser, said handle being mounted with its length extending vertically with respect to the dispenser, said press bar being pivotally mounted about its upper portion at a pivot point for inward and outward rotation with respect to said enclosure and including at its lower portion a rack which engages the pinion coupled to the drive roller wherein said drive roller is adapted to advance said paper towel web through said nip upon pivotal motion of said press bar;

(e) wherein said vertically oriented press bar is laterally located with respect to the dispensing nip adjacent one of the sidewall portions of the dispenser such that its inward and outward motion with respect to the dispenser does not interfere with paper towel being fed through the dispensing nip of the dispenser; and wherein the press bar has a top and a bottom separated by a distance and the rack is disposed more than about 65% of that distance from the top of the press bar toward the bottom of the press bar; and wherein (i) the press bar and the vertically oriented press bar handle are mounted and configured such that the vertically oriented press bar handle defines a forwardly projecting substantially vertical plane of rotation with the pivot point upon rotation of the press bar thereabout, the rack, the pinion and the vertically oriented press bar handle remaining generally in said forwardly projecting substantially vertical plane of rotation upon inward and outward rotation of the press bar; and (ii) the rack of the press bar is aligned with a lower portion of the vertically oriented press bar handle; and wherein further the vertically oriented press bar handle and vertically oriented press bar are mounted and configured such that the upper portion of the press bar handle is in vertical proximity with the pivot point and the lower portion of the press bar handle is in vertical proximity with the rack so that the force required for operation of the dispenser is generally horizontal, lying within the forwardly projecting substantially vertical plane of rotation;

(f) means for biasing said press bar toward said front portion of said dispenser enclosure such that the press bar projects forwardly therefrom in a rest position;

(g) a dispensing chute located below said dispensing nip with a lower shelf configured to direct said web forwardly toward the front portion of said dispenser enclosure; and (h) a cutting blade disposed below said dispensing nip and above the lower shelf of said dispensing chute.

* * * * *

UNITED STATES PATENT AND TRADEMARK OFFICE

CERTIFICATE OF CORRECTION

PATENT NO. : 9,010,602 B2
APPLICATION NO. : 10/366120
DATED : April 21, 2015
INVENTOR(S) : Gregory D. Budz et al.

It is certified that error appears in the above-identified patent and that said Letters Patent is hereby corrected as shown below:

In the Specification

At column 12, line 25, after “rotates elongate” delete “die”.

Signed and Sealed this
Twenty-fifth Day of August, 2015

Michelle K. Lee

Michelle K. Lee
*Director of the United States Patent and Trademark Office*